US012736062B2

(12) United States Patent
Maggard et al.

(10) Patent No.: US 12,736,062 B2
(45) Date of Patent: Sep. 15, 2026

(54) AIR BLOWING APPARATUS WITH AUXILIARY FAN HOUSING AND AUXILIARY BAFFLE

(71) Applicant: MTD PRODUCTS INC, Valley City, OH (US)

(72) Inventors: Jay Maggard, Polk, OH (US); Jeffrey R. Kucera, Medina, OH (US); Garrett Rosinski, Akron, OH (US); Dominic Kedelty, Maricopa, AZ (US); Jacob Petersen, Phoenix, AZ (US)

(73) Assignee: MTD Products Inc, Valley City, OH (US)

( * ) Notice: Subject to any disclaimer, the term of this patent is extended or adjusted under 35 U.S.C. 154(b) by 0 days.

(21) Appl. No.: 18/431,557

(22) Filed: Feb. 2, 2024

(65) Prior Publication Data

US 2024/0263642 A1 Aug. 8, 2024

Related U.S. Application Data

(60) Provisional application No. 63/525,778, filed on Jul. 10, 2023, provisional application No. 63/443,012, filed on Feb. 2, 2023.

(51) Int. Cl.
*F04D 29/42* (2006.01)
*F04D 25/08* (2006.01)

(52) U.S. Cl.
CPC ..... *F04D 29/4226* (2013.01); *F04D 25/08* (2013.01)

(58) Field of Classification Search
CPC .... F04D 29/4226; F04D 25/08; F04D 17/105; F04D 17/12; F04D 17/162; F04D 17/164; F04D 29/424; F04D 29/4246
(Continued)

(56) References Cited

U.S. PATENT DOCUMENTS 4,132,507 A * 1/1979 Akiyama ..... B05B 1/005 417/364
6,076,231 A * 6/2000 Bucher ..... A47L 9/02 15/415.1

(Continued)

FOREIGN PATENT DOCUMENTS

CN 103321171 B 9/2015
WO 2021/182819 A1 9/2021

OTHER PUBLICATIONS

Search Report and Written Opinion for International Application No. PCT/US2024/014295, dated May 21, 2024, 10 pages long.

*Primary Examiner* — Mark A Laurenzi
*Assistant Examiner* — Kelsey L Stanek
(74) *Attorney, Agent, or Firm* — Wegman Hessler

(57) ABSTRACT

An air blowing apparatus having an auxiliary housing and auxiliary air flow output that can be selectively engaged and disengaged is described herein. In an embodiment of the disclosure, the auxiliary housing can comprise an auxiliary fan to generate a second high speed air flow to supplement a high volume air flow of a primary housing. When baffled, the auxiliary fan is isolated from air intake and can be driven with little power consumption. An air blowing apparatus can be a backpack-style apparatus or hand-held air blowing apparatus. As examples, one airflow can have a relatively high volumetric flowrate relative to another airflow, or can have a high air speed relative to another airflow, or can have a high energy relative to another airflow, and so forth.

19 Claims, 20 Drawing Sheets

(58) Field of Classification Search
USPC ..... 415/182.1
See application file for complete search history.

(56) References Cited

U.S. PATENT DOCUMENTS

| | | | | |
|---|---|---|---|---|
| 6,928,693 | B1 * | 8/2005 | Ericson | A47L 5/14 15/327.5 |
| 7,600,290 | B1 * | 10/2009 | Peters | A47L 5/36 15/327.5 |
| 8,177,914 | B2 * | 5/2012 | Peters | E01H 1/0809 15/327.5 |
| 8,671,516 | B1 * | 3/2014 | Mendez | A01G 20/47 15/327.5 |
| 10,935,039 | B2 | 3/2021 | Kedelty et al. | |
| 10,947,983 | B2 | 3/2021 | Hoffman | |
| 2016/0286731 | A1 * | 10/2016 | Smith | A01G 20/47 |
| 2020/0305360 | A1 | 10/2020 | Lhoste-Clos | |
| 2020/0383281 | A1 * | 12/2020 | Zhou | F04D 25/16 |
| 2023/0097990 | A1 * | 3/2023 | Cho | F04D 29/162 415/204 |
| 2023/0189727 | A1 * | 6/2023 | Mandel | B25F 5/008 15/405 |
| 2023/0287902 | A1 * | 9/2023 | Eckard | A01G 20/47 |

* cited by examiner

EXAMPLE MULTI-OUTPUT PORTABLE AIR BLOWER
100

EXAMPLE MULTI-OUTPUT PORTABLE AIR BLOWER
100

EXAMPLE MULTI-OUTPUT PORTABLE AIR BLOWER
100

ALTERNATIVE EXAMPLE MULTI-OUTPUT PORTABLE AIR BLOWER
600

ALTERNATIVE EXAMPLE MULTI-OUTPUT PORTABLE AIR BLOWER
600

EXAMPLE MULTI-OUTPUT AIR BLOWER WITH HORIZONTAL BACK-MOUNTED CENTRIFUGAL FANS
1600

EXAMPLE MULTI-OUTPUT AIR BLOWER WITH AIRFLOW DIVERTER AND DUAL-AXIAL FANS
2000

AIR BLOWING APPARATUS WITH AUXILIARY FAN HOUSING AND AUXILIARY BAFFLE

CROSS REFERENCE TO RELATED APPLICATIONS

This application for patent claims the benefit of priority to U.S. Provisional Patent Application No. 63/443,012 entitled AIR BLOWING APPARATUS WITH AUXILIARY FAN HOUSING AND AUXILIARY BAFFLE and filed Feb. 2, 2023 and to U.S. Provisional Patent Application No. 63/525,778 entitled AIR BLOWING APPARATUS HAVING MULTIPLE AIRFLOW OUTPUTS WITH A DIFFERENT FLUID DYNAMIC CHARACTERISTIC and filed Jul. 10, 2023, each of which are hereby incorporated by reference herein in their respective entireties and for all purposes.

INCORPORATION BY REFERENCE

U.S. Pat. No. 10,299,642B2 issued May 28, 2019, U.S. Pat. No. 10,935,039B2 issued Mar. 2, 2021, U.S. patent application Ser. No. 15/174,840 filed Jun. 6, 2016 and U.S. patent application Ser. No. 15/805,465 filed Nov. 7, 2017, are hereby incorporated by reference herein in their respective entireties and for all purposes.

FIELD OF DISCLOSURE

The disclosed subject matter pertains to apparatuses for powered air blowing equipment, for instance, a hand-held air blowing apparatus with auxiliary fan housing and operator selectable auxiliary baffle.

BACKGROUND

It is known that in many applications, such as in the agricultural field, when cleaning of streets and pavements or grasslands is concerned, as well as for other similar application fields, portable blowing apparatuses are used which are adapted to produce a pressurized air jet to propel debris and loose material in a desired direction.

In these applications, a blowing apparatus generally might have a two-stroke internal combustion engine moving a centrifugal fan wheel adapted to generate a substantially radial air flow. The fan wheel is externally surrounded by a volute header adapted to convey the air flow from radial direction to linear direction. Part of the delivery air flow is deviated from the provided main use and conveyed towards the engine sometimes contained at least partly in a casing, for cooling of the engine itself.

While improving engine performance, deviation of air from the fan wheel to cooling reduces optimal yield of air flow delivery to the pressurized air jet output from the blowing apparatus. The proportion of air flow generated by the fan wheel to that directed to perform desired work of propelling debris and loose material is likewise reduced. Where power consumption is not of concern, a desired air output can be achieved simply by increasing engine size or fan wheel size and geometry to generate a larger amount of radial air flow from the fan wheel. Where power efficiency is of concern, however, this is not necessarily a preferred solution to achieving optimal yield of linear air flow, particularly when the increase engine size or fan wheel size/geometry is constant.

Accordingly, further efforts are ongoing to develop an air blowing apparatus that can optimize linear air flow output and provide increased air flow performance while reducing power consumption or operating with improved power efficiency.

BRIEF SUMMARY

The following presents a simplified summary in order to provide a basic understanding of some aspects of the disclosure. This summary is not an extensive overview of the disclosure. It is not intended to identify key/critical elements or to delineate the scope of the disclosure. Its sole purpose is to present some concepts of the disclosure in a simplified form as a prelude to the more detailed description that is presented later.

Various embodiments of the present disclosure provide an air blowing apparatus having an auxiliary housing and auxiliary air flow output that can be engaged when additional air flow performance is required, and can be baffled to reduce power consumption when not required. The air blowing apparatus can be powered by an electric motor and rechargeable battery(ies), in some embodiments, although the disclosure is not limited to such embodiments. In various aspects of the disclosed embodiments, the auxiliary housing can comprise an auxiliary fan to generate a second radial air flow converted to a second linear air flow by the auxiliary air flow output. When baffled, the auxiliary fan is cut off from air intake and can be driven with little power consumption. When unbaffled, the auxiliary fan receives air external to the air blowing apparatus and generates the second linear air flow. In particular aspects of the disclosed embodiments, the auxiliary air flow output can be configured to provide a high speed and high pressure output from the air blowing apparatus, which can be in addition to a high volume air flow output produced by a primary fan and a primary air flow output of the air blowing apparatus. Accordingly, the disclosed air blowing apparatus can provide a high volume primary output full time, and a high speed and high pressure output only when selected by the operator. When not desired, a selectable baffle can be closed to minimize air resistance against the auxiliary fan and minimize power consumption thereof.

Embodiments of the present disclosure provide an air blowing apparatus having dual output shafts. Some embodiments include a backpack-style air blowing apparatus, whereas other embodiments include a hand-held air blowing apparatus. The dual output shafts can output respective airflows. Moreover, the airflows can have different fluid flow characteristics. For instance, one airflow can have a relatively high volumetric flowrate relative to another airflow, or can have a high air speed relative to another airflow, or can have a high energy relative to another airflow, or the like, or a suitable combination of the foregoing. In some backpack-style air blowing apparatuses, an armature with at least one rotational axis can secure the fan housing(s) and output shafts to a fan body to facilitate change in position, orientation or both of the fan housing(s) and output shafts. In some embodiments, the dual output shafts can be fluidly coupled to respective fan housings enclosing respective fans generating respective airflows. In other embodiments, the dual output shafts can be fluidly coupled to respective fan housing interiors enclosing and in fluid communication with respective sides of a dual-sided fan generating respective airflows. In another embodiment, a fan housing of a set of fan housings can have a selectively baffled air intake to suppress or turn off one airflow of a set of multiple airflows. In some embodiments, an airflow coupler can be provided between a first and a second output shaft with a selective diverter valve that can selectively divert one airflow from the first output shaft into the second output shaft to combine with another airflow within the second output shaft.

In an aspect of the disclosed embodiments, disclosed is an air blowing apparatus, that can comprise a fan coupled to a drive mechanism that defines an axis of rotation for the fan and can comprise a fan housing enclosing the fan and that defines a space within which the fan rotates in response to a rotational force applied to the drive mechanism. Further, the air blowing apparatus can comprise a motor coupled to the drive mechanism that generates and applies the rotational force to the drive mechanism causing the fan to rotate within the fan housing, an intake defined at a surface of the fan housing for receiving air external to the air blowing apparatus into the fan housing, the air interacting with the fan, wherein rotation of the fan within the fan housing while in communication with the air generates first pressurized air and a first output fluidly coupled with the fan housing that receives the first pressurized air and directs the first pressurized air to a first blower exhaust port. Additionally, the air blowing apparatus can comprise a second fan housing and a second intake defined adjacent to the second fan housing having a variable baffle opening that is adjustable between an open position and a closed position, wherein second external air is received from outside the air blowing apparatus into the second fan housing in response to the variable baffle opening being in the open position and the second external air is impeded from entering the second fan housing in response to the variable baffle opening being in the closed position. Still further, the air blowing apparatus can comprise a second output fluidly coupled with the second fan housing that receives second pressurized air generated within the second fan housing in response to the rotational force applied to the drive mechanism and in response to the variable baffle opening being in the open position, wherein the second output directs the second pressurized air to a second blower exhaust port.

In further aspects of the disclosed embodiments there is provided a hand-held air blowing apparatus having multiple air output ports. The hand-held air blowing apparatus can comprise a first output port having a first output surface area and a second output port having a second output surface area, wherein the second output surface area is smaller than the first output surface area. In addition to the foregoing, the hand-held air blowing apparatus can comprise a first housing coupled to the first output port and physically isolated from the second output port, a second housing coupled to the second output port and physically isolated from the first output port and can comprise a motor providing mechanical power to the first housing or the second housing, or both. Still further, the hand-held air blowing apparatus can comprise an air pressurization means responsive to the mechanical power output by the motor and configured to generate first pressurized air within the first housing and expelled from the first housing via the first output port and configured to conditionally generate second pressurized air within the second housing and expelled via the second output port.

In an embodiment, the present disclosure provides an air blowing apparatus. The air blowing apparatus can comprise a body that defines a rigid structure, and can comprise one or more straps secured to the body configured to secure the air blowing apparatus to an operator. Further, the air blowing apparatus can comprise a motor that generates mechanical power and a blower housing and a blower fan contained within the blower housing and powered by the motor to generate air pressure within the blower housing. The air blowing apparatus can also comprise an output shaft having an input fluidly coupled to the blower housing and a chute for directing an air flow in response to generation of the air pressure within the blower housing, and can comprise a second output shaft adjacent to the output shaft having an input fluidly coupled to the blower housing or to a second blower housing that is adjacent the blower housing, wherein the second output shaft has a second chute for directing a second air flow from the blower housing or from the second blower housing. Still further, the air blowing apparatus can comprise a support arm secured at a first support coupling to the blower housing and secured at a second support coupling to the body of the air blowing apparatus to support a weight of the blower housing, output shaft and second output shaft a distance from the body of the air blowing apparatus, and having at least one axis of rotation to adjust an orientation or a position of the blower housing, output shaft and second output shaft.

In one or more additional embodiments of the present disclosure, provided is an air blowing apparatus configured to removably secure to a torso of an operator. The air blowing apparatus can comprise a body providing a rigid support structure, and a strap assembly coupled to the body of the air blowing apparatus and configured to removably secure the body to a torso of an operator. Additionally, the air blowing apparatus can comprise a fan housing connected to the body and enclosing a fan coupled to a drive mechanism and defining a first fan housing output, and a motor having a motor output connected to the drive mechanism, wherein the motor generates mechanical power at the motor output to drive rotation of the fan. Moreover, the air blowing apparatus can comprise an airflow output defining an intake port coupled to the fan housing output and directing airflow generated in response to rotation of the fan within the fan housing along a length of the airflow output to a first output port, and can comprise a second airflow output defining a second intake port coupled to a second fan housing output and directing second airflow from the second fan housing output along a length of the second airflow output to a second output port. In various embodiments, the second airflow defines at least one of a different volumetric flow rate or a different airflow speed than the airflow.

Further embodiments of the present disclosure provide an air blowing apparatus. The air blowing apparatus can comprise a motor having a motor output generating mechanical power. The air blowing apparatus can comprise a fan housing enclosing a fan coupled to the motor output and defining a first fan housing output and a second fan housing defining a second fan housing output. Furthermore, the air blowing apparatus can comprise an airflow output shaft defining an intake port fluidly coupled to the first fan housing output and directing airflow generated in response to rotation of the fan within the fan housing along a length of the airflow output to a first output port, and also can comprise a second airflow output shaft defining a second intake port fluidly coupled to the second fan housing output and receiving second airflow, generated within the second fan housing, from the second fan housing output. In addition to the foregoing, the air blowing apparatus can comprise an air output coupler that connects the second airflow output shaft with the airflow output shaft. In various embodiments, the air blowing apparatus can also comprise a selectable diverter valve located at least at an intersection of the air output coupler and the second airflow output shaft having a first orientation and a second orientation. In some embodiments, in the first orientation the selectable diverter valve directs the second airflow from the second fan housing output to a second output port defined by the second airflow output shaft. In further embodiments, in the second orientation the selectable diverter valve directs the second airflow from the second fan housing output through the air output coupler into the airflow output shaft and out the first output port together with the airflow.

To accomplish the foregoing and related ends, certain illustrative aspects of the disclosure are described herein in connection with the following description and the drawings. These aspects are indicative, however, of but a few of the various ways in which the principles of the disclosure can be employed and the subject disclosure is intended to include all such aspects and their equivalents. Other advantages and features of the disclosure will become apparent from the following detailed description of the disclosure when considered in conjunction with the drawings.

Figure 1:
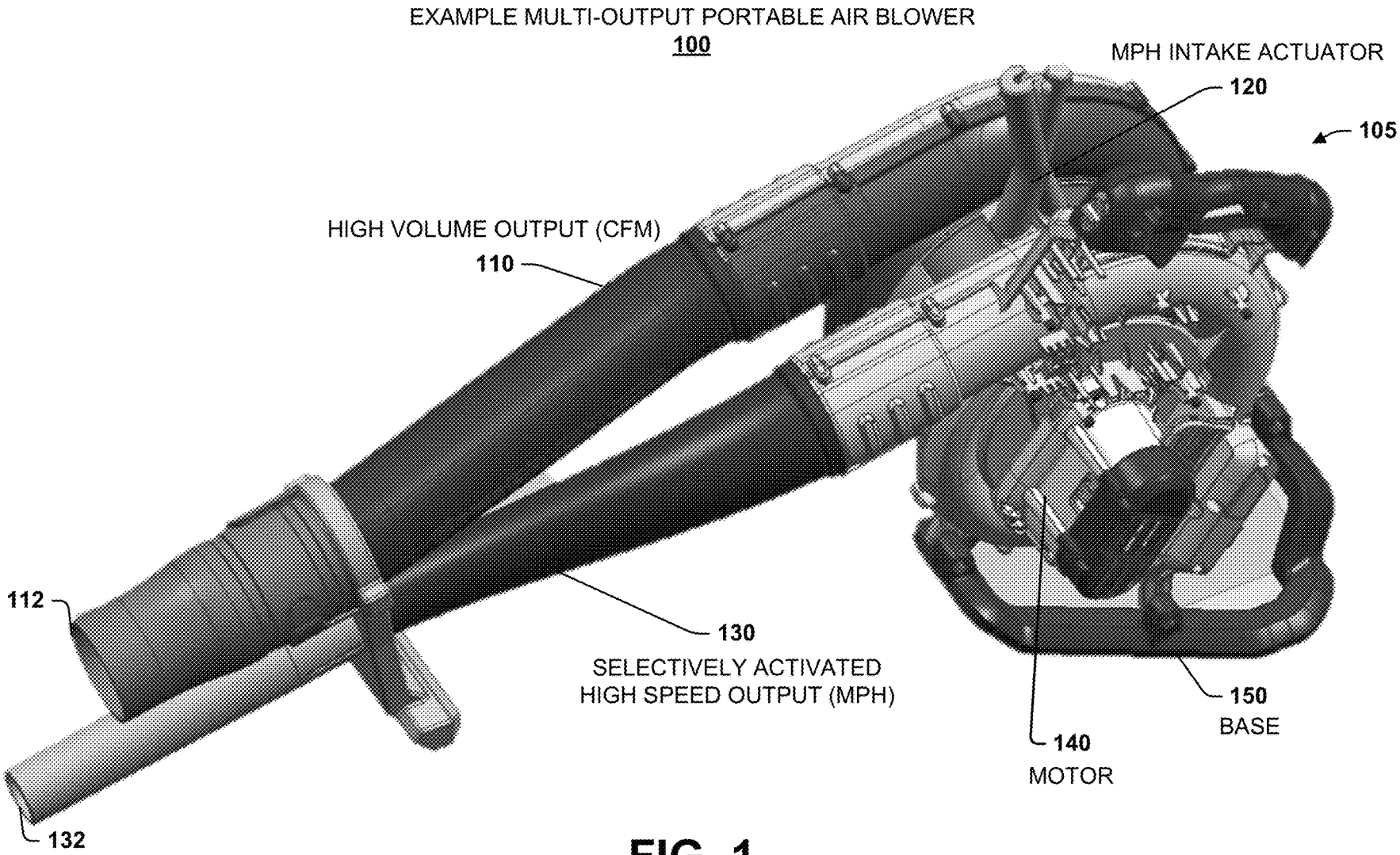
FIG. 1 depicts an example multi-output portable air blower apparatus according to aspects of the present disclosure.

It should be noted that the drawings are diagrammatic and not drawn to scale. Relative dimensions and proportions of parts of the figures have been shown exaggerated or reduced in size for the sake of clarity and convenience in the drawings. The same reference numbers are generally used to refer to corresponding or similar features in the different embodiments, except where clear from context that same reference numbers refer to disparate features. Accordingly, the drawings and description are to be regarded as illustrative in nature and not as restrictive.

While embodiments of the disclosure pertaining to machine vision systems for power equipment machines are described herein, it should be understood that the disclosed machines, electronic and computing devices and methods are not so limited and modifications may be made without departing from the scope of the present disclosure. The scope of the systems, methods, and electronic and computing devices for machine vision devices are defined by the appended claims, and all devices, processes, and methods that come within the meaning of the claims, either literally or by equivalence, are intended to be embraced therein.

DETAILED DESCRIPTION

As utilized herein, the term "substantially" and other relative terms or terms of degree (e.g., about, approximately, substantially, near and so forth) are intended to have the meaning specified explicitly in conjunction with their use herein, or a meaning which can be reasonably inferred by one of ordinary skill in the art, or a reasonable variation of a specified quality(ies) or quantity(ies) that would be understood by one of ordinary skill in the art by reference to this entire specification (including the knowledge of one of ordinary skill in the art as well as material incorporated by reference herein). As an example, a term of degree could refer to reasonable manufacturing tolerances about which a specified quality or quantity could be realized with fabrication equipment. Thus, as a specific illustration, though non-limiting, for an element of an apparatus expressly identified as having a dimension of about 50 centimeters (cm), the relative term "about" can mean reasonable variances about 50 cm that one of ordinary skill in the art would anticipate the specified dimension of the element could be realized with commercial fabrication equipment, industrial fabrication equipment, laboratory fabrication equipment, or the like, and is not limited to a mathematically precise quantity (or quality). In other examples, a term of degree could mean a variance of +/−0-3%, +/−0-5%, or +/−0-10% of an expressly stated value, where suitable to one of ordinary skill in the art to achieve a stated function or feature of an element disclosed herein. In still other examples, a term of degree could mean any suitable variance in quality (ies) or quantity(ies) that would be suitable to accomplish an explicitly disclosed function(s) or feature(s) of a disclosed element. Accordingly, the subject specification is by no means limited only to specific qualities and quantities disclosed herein, but includes all variations of a specified quality(ies) or quantity(ies) reasonably conveyed to one of ordinary skill in the art by way of the context disclosed herein.

FIG. 1 illustrates an example multi-output portable air blower apparatus 100 according to various aspects of the present disclosure. Air blower apparatus 100 includes a motor 140 and a base 150 secured to a housing. An operator handle 105 provides a control point for an operator to lift and hold air blower apparatus 100 and a trigger to activate or deactivate motor 140. Base 150 provides a support structure for air blower apparatus 100 to rest upon the ground in a manner suitable to structural and operational integrity of air blower apparatus 100.

As shown, air blower apparatus 100 can comprise a high volume output 110 (also referred to as a high cubic feet per meter (CFM) output) secured to the housing, and a selectively activated high speed output 130 (also referred to as a mile per hour (MPH) output) secured to the housing. An MPH intake actuator 120 enables an operator to selectively activate or deactivate the selectively activated high speed output 130 (e.g., see FIGS. 8A and 8B, infra). When activated, selectively activated high speed output 130 can provide a high speed pressurized air flow at a high speed exhaust port 132 to supplement a high volume pressurized air flow at a high volume exhaust port 112. The high speed pressurized air flow can provide an extra boost to assist the high volume pressurized air flow in moving debris, dirt, leaves, grass and vegetation clippings, and the like on a surface in front of air blower apparatus 100. Activation of selectively activated high speed output 130 results in high power consumption at motor 140 to accomplish the boost in air output. However, upon deactivation, the selectively activated high speed output 130 can be stopped restoring a normal (e.g., lower) power consumption of motor 140. In at least some embodiments, motor 140 can be an electric motor powered by an electric power source whether a direct current (DC) power source (e.g., rechargeable battery(ies)) or alternating current (AC) power source (e.g., electric cord coupled to a fixed AC power source, such as an AC outlet, etc.). However, the subject disclosure is not so limited, and in other embodiments motor 140 can be a combustion engine, hydraulic motor, pneumatic motor, or the like.

High volume exhaust port 112 can have a first surface area and high speed exhaust port 132 can have a second surface area. In various aspects of the disclosed embodiments, the second surface area can be smaller than the first surface area. Moreover, an interface between selectively activated high speed output 130 and the housing of air blower apparatus 100 can have the same or similar surface area as an interface between high volume output 110 and the housing. Selectively activated high speed output 130 can therefore narrow in surface area as it extends from the housing to high speed exhaust port 132 more than high volume output 110 narrows from the housing to high volume exhaust port 112.

Figure 2:
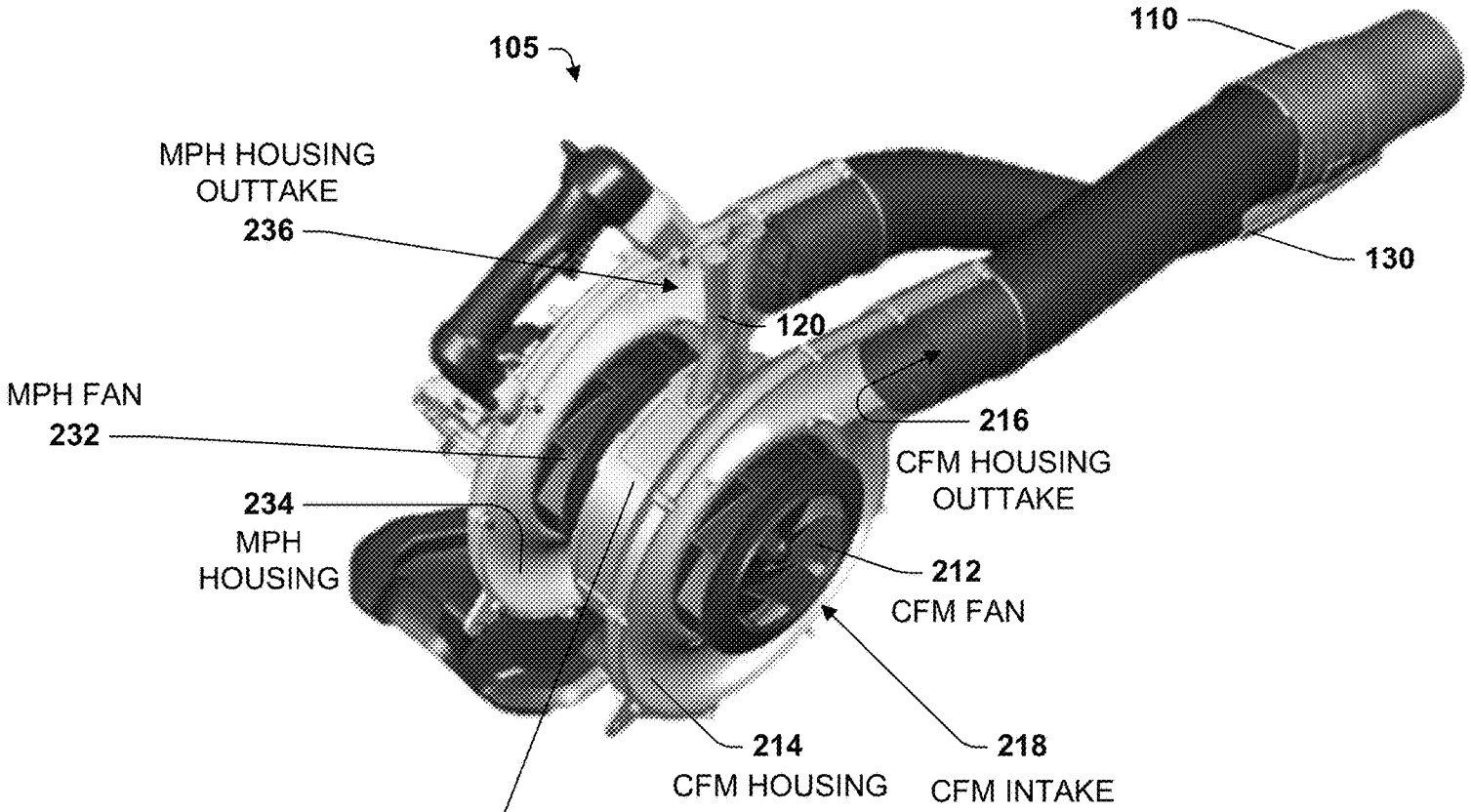
FIG. 2 illustrates a view of the multi-output portable air blower apparatus with transparent fan housing according to aspects of the present disclosure.

FIG. 2 depicts example multi-output portable air blower apparatus 100 with portions of the housing made transparent to show an interior of the housing. Particularly, the housing includes both a CFM housing 214 and a MP housing 234 as shown. CFM housing 214 can include a CFM fan 212 therein and a CFM intake 218. CFM intake 218 defines an opening or partial opening in CFM housing 214 to provide air external to air blower apparatus 100 into CFM housing 214 to be in communication with CFM fan 212. When rotated in response to mechanical power output by motor 140, CFM fan 212 can generate pressurized air within CFM housing 214 to be output through CFM housing outtake 216 to high volume output 110. This creates the high volume pressurized air flow output from air blower apparatus 100 by way of high volume exhaust port 112 (e.g., see FIG. 1, supra).

In aspects of the disclosed embodiments, CFM housing 214 can be partially or wholly isolated from MPH housing 234. This mitigates or avoids air received by CFM intake 218 from entering MPH housing 234. Rather, air blower apparatus 100 can include an MPH intake with adjustable baffle 222 responsive to MPH intake actuator 120. With MPH intake actuator 120 in a closed position, as shown in FIG. 2, MPH housing 234 is shut off from external air allowing MPH fan 232 to rotate within MPH housing 234 with little air resistance. This minimizes power consumption associated with rotation of MPH fan 232 when a high speed pressurized air flow from high speed exhaust port 132 is not desired (e.g., see FIG. 8B, infra). When the high speed pressurized air flow is desired, MPH intake actuator 120 can be adjusted to an open position that opens baffle surfaces in MPH intake with adjustable baffle 222. The opened baffle surfaces (e.g., see FIG. 3, infra) receive additional air external to air blower apparatus 100 into MPH intake with adjustable baffle 222 and MP housing 234. This additional air comes in communication with MPH fan 232, which can generate additional pressurized air within MPH housing 234 to be output through MPH housing outtake 236 to selectively activated high speed output 130. This creates the high speed pressurized air flow output from air blower apparatus by way of high speed exhaust port 132.

As shown in FIG. 2, MPH intake with adjustable baffle 222 is positioned between CFM housing 214 and MPH housing 234. Additionally, motor 140 is shown on a left side of MPH housing 234. Other arrangements can be implemented according to various aspects of the disclosed embodiments. For instance, CFM housing 214 can be swapped with MPH housing 234 in orientation such that CFM housing 214 is adjacent motor 140 as an alternative. In the latter alternative, CFM intake 218 can be between CFM housing 214 and motor 140, or can take the place of MPH intake with adjustable baffle 222. In the latter case, MPH intake with adjustable baffle 222 can be on a right side of MPH housing 234 (with MPH housing 234 swapped with CFM housing 214). In still another embodiment, MPH intake with adjustable baffle 222 can be on a left side of MPH housing 234 between motor 140 and MPH housing 234. In this embodiment, CFM intake 218 can be between MPH housing 234 and CFM housing 214, or MPH housing 234 can be immediately adjacent CFM housing 214 with CFM intake 218 on the right side of CFM housing 214 as shown.

As is evident from FIG. 2, CFM housing outtake 216 couples high volume output 110 with CFM housing 214 at an upper portion of CFM housing 214. Likewise, MPH housing outtake 236 couples selectively activated high speed output 130 with MPH housing 234 at an upper portion of MPH housing 234. This arrangement can be changed in different aspects of the disclosed embodiments without departing from the scope of the present disclosure. For instance, CFM housing 216 can interface with CFM housing outtake 216 at a middle portion of CFM housing 216, or a lower portion of CFM housing 216. Alternatively, MPH housing outtake 236 can couple selectively activated high speed output 130 to a middle portion of MPH housing 234 or a lower portion of MPH housing 234. In at least some disclosed embodiments, both CFM housing outtake 216 and mph housing outtake 236 can connect high volume output 110 and selectively activated high speed output 130, respectively, to lower portions of CFM housing 214 and MPH housing 234 (e.g., see FIG. 6, infra).

Figure 3:
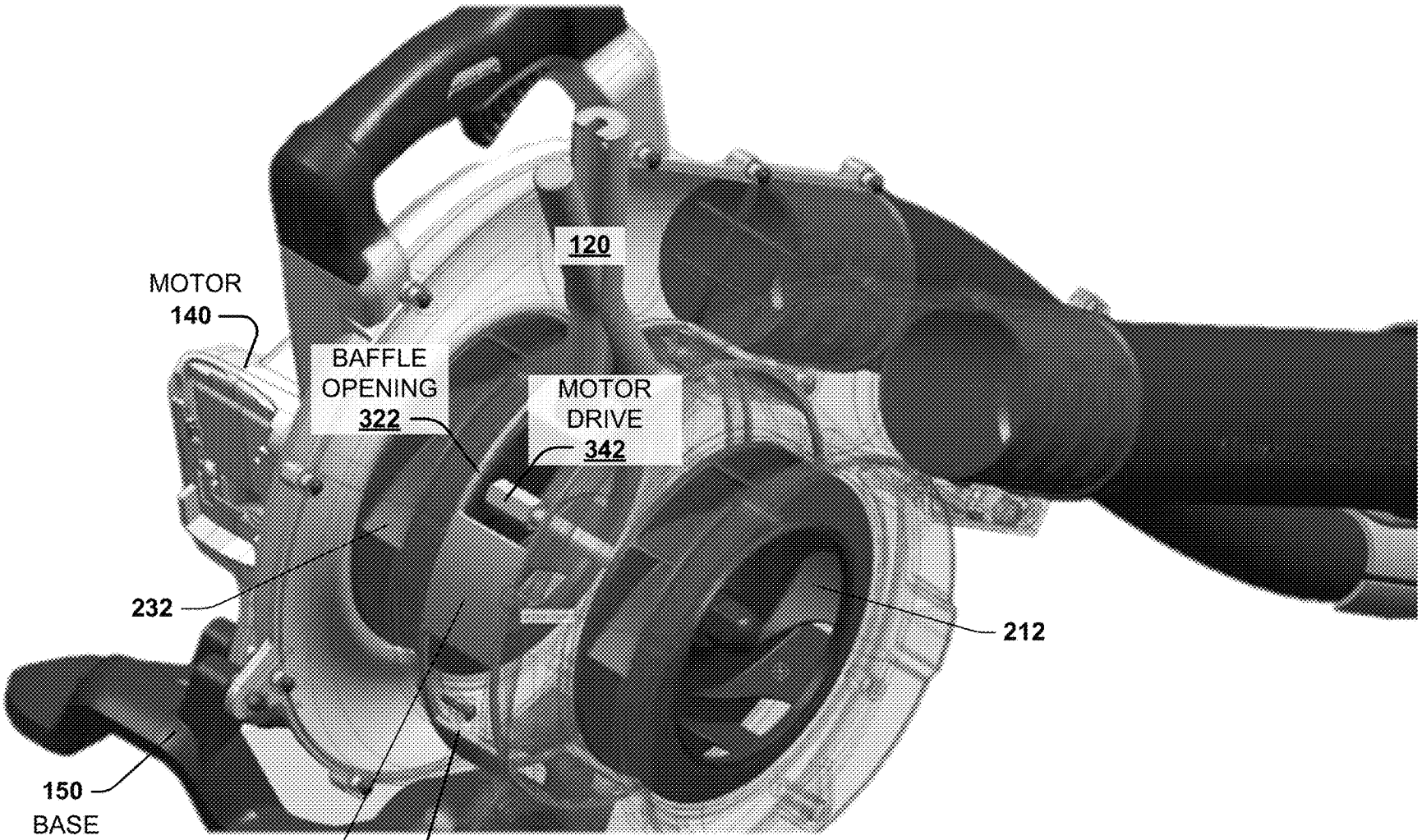
FIG. 3 depicts a view of the multi-output portable air blower apparatus with transparent primary housing according to further aspects disclosed herein.

FIG. 3 illustrates a rear view of air blower apparatus 100 according to further aspects of the disclosed embodiments. As shown in FIG. 3, CFM housing 214 is transparent to show CFM fan 212 and MPH fan 232 connected to a motor drive 342. In one or more aspects of the disclosed embodiments, motor drive 342 can be a drive shaft secured to motor 140 that rotates in response to mechanical power output by motor 140. Motor drive 342 can also be secured to MPH fan 232 and to CFM fan 212 to rotate MPH fan 232 and CFM fan 212 in response to the mechanical power of motor 140.

As described herein, rotation of CFM fan 212 generates pressurized air within CFM housing 214 from external air received within CFM housing 214 through CFM intake 218. Rotation of MPH fan 232 can conditionally generate pressurized air within MPH housing 234. MPH intake with adjustable baffle 222 shares an opening with MPH housing 234 such that air freely exchanges between MPH housing 234 and the interior of MPH intake with adjustable baffle 222. In an open position, therefore, one or more baffle openings 322 expose an interior of MPH intake with adjustable baffle 222 as well as MPH fan 232 within MPH housing 234 to air exterior to air blower apparatus 100. This brings external air into communication with rotating MPH fan 232, to generate second pressurized air. With MPH intake with adjustable baffle 222 closed, baffle openings 322 are closed as shown in FIG. 2, preventing air external to air blower apparatus 100 from entering MPH housing 234.

In one or more aspects of the disclosed embodiments, motor 140 is connected to air pressurization means disposed within CFM housing 214 and MPH housing 234. In some aspects, the air pressurization means includes CFM fan 212, MPH fan 232 and drive motor 342, but the subject disclosure is not so limited. For instance, air pressurization means can include a non-bladed fan, including a multi-disc flat turbine such as a tesla turbine, or the like. Further, air pressurization means can include a suitable electric or mechanical air pump(s) (e.g., a vane pump, a reciprocating pump, a piston pump, an impeller pump, a diaphragm pump, or the like), a hydraulic air pump(s), a pneumatic air pump(s), a vacuum pump, or other suitable air pressurization mechanism situated partly within CFM housing 214 and partly within MPH housing 234. Within CFM housing 214, the air pressurization means has a continuous supply of external air through CFM intake 218. Within MPH housing 234 the air pressurization means has a conditional supply of external air through baffle openings 322 of MPH intake with adjustable baffle 222 (when open).

Figure 4:
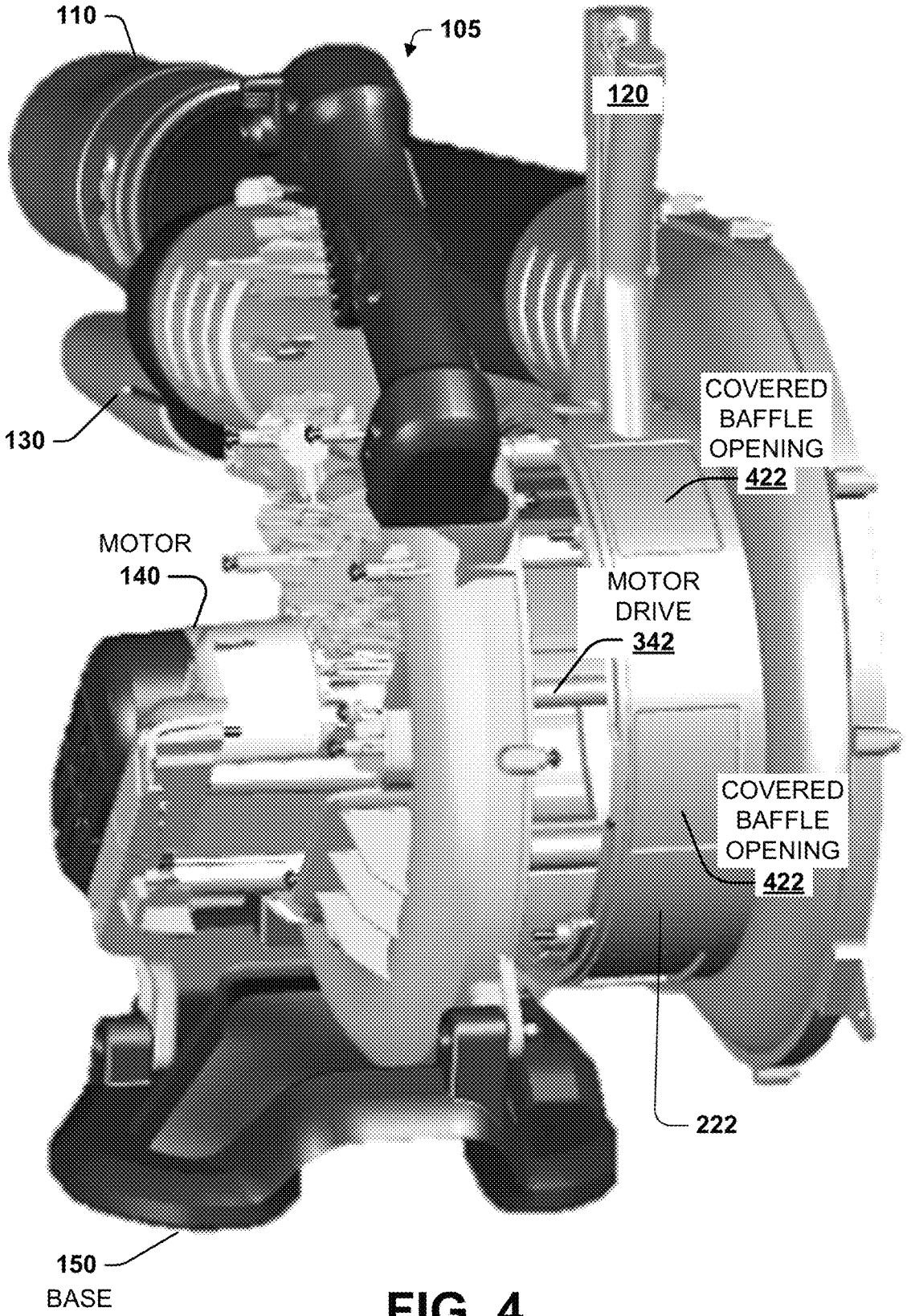
FIG. 4 illustrates a rear view of the multi-output portable air blower apparatus with transparent fan housing, one or more aspects of the disclosed embodiments.

FIG. 4 illustrates a rear motor side view of air blower apparatus 100. Air blower apparatus 100 is depicted as it would appear with base 150 resting on a flat surface, such as the ground. Motor 140 is secured to MPH housing 234 above base 150. Operator handle 105 is secured to a top surface of MPH housing 234, having an operator trigger to activate and deactivate motor 140. An interior portion of MPH housing 234 is made transparent allowing motor drive 342 to be visible within MPH intake with adjustable baffle 222 between MPH housing 234 and CFM housing 214. MPH intake with adjustable baffle 222 is also shown with covered baffle openings 422, preventing (significant) external air from entering MPT intake with adjustable baffle 22 and MPH housing 234 as described herein. Activation of MPH intake actuator 120 can be utilized to shut off and close the adjustable baffle as shown by covered baffle openings 422 and can be utilized to open the adjustable baffle as shown by baffle openings 322, or any suitable partial opening there between.

Figure 5:
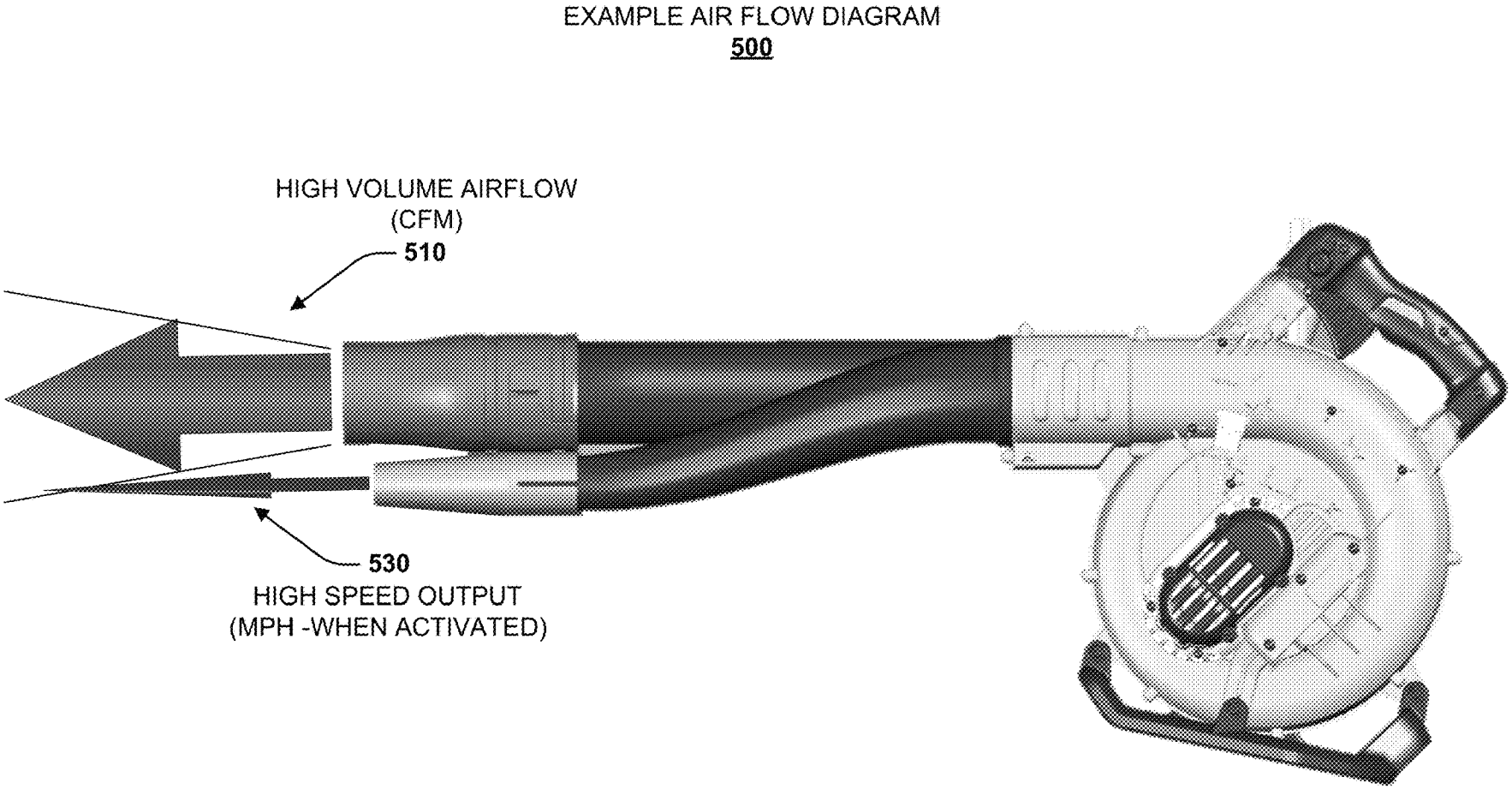
FIG. 5 depicts an example drawing of the multi-output portable air blower apparatus and a representation of respective high volume and high speed air outputs.

FIG. 5 depicts an example air flow diagram 500 for air blower apparatus 100 in one or more aspects of the disclosed embodiments. High volume airflow 510 is a relatively wide air flow for moving a large amount of air from air blower apparatus 100 through high volume output 110. High volume airflow 510 can be effective to rapidly move a large amount of lightweight debris in front of air blower apparatus 100. High speed airflow 530 (when activated) can have a relatively narrow flow of (higher) pressurized air effective to move heavier (e.g., wet) or compressed debris from in front of air blower apparatus 100. Furthermore, high speed output 530 can be oriented to lift debris off of a surface upward into high volume airflow 510 to be blown free from surface friction in front of air blower apparatus 100. Accordingly, high speed output 530 can supplement the debris removal effectiveness of air blower apparatus 100.

Figure 6:
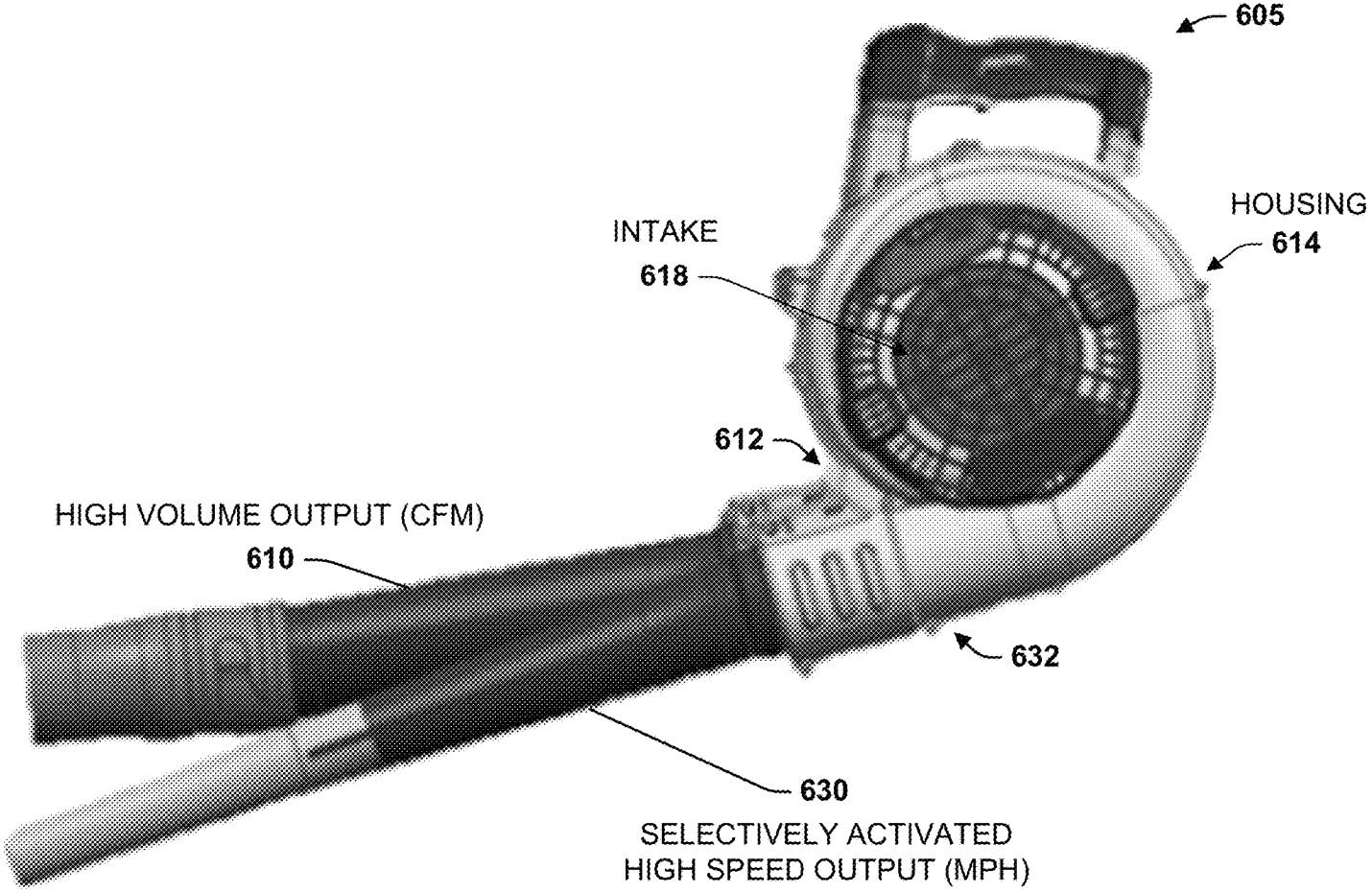
FIG. 6 illustrates an example multi-output portable air blower apparatus according to further aspects of the disclosed embodiments.

FIG. 6 illustrates an alternative example multi-output air blower apparatus 600 according to further aspects of the disclosed embodiments. Air blower apparatus 600 can comprise an operator handle 605, and an intake 618 on a near-side surface of a housing 614. In an embodiment, a motor (not depicted, but see FIG. 7, infra) can be on the side of intake 618, or can be on a back side of housing 614 and thus not visible in FIG. 6. The motor can engage an air pressurization means (e.g., as described at FIG. 3, supra) contained within housing 614 providing pressurized air flow through a high volume output 610, through a selectively activated high speed output 630, or both.

High volume output 610 intersects housing 614 at a bottom portion 612 thereof. Likewise, selectively activated high speed output 630 can intersect housing 614 at another bottom portion 632 thereof. While high volume output 610 intersects housing 614 at bottom portion 612 shown in a rear of housing 614 and selectively activated high speed output 630 intersects housing 614 at bottom portion 632 shown in a front of housing 614, this orientation can be reversed with selectively activated high speed output 630 intersecting housing 614 at bottom portion 612 in the rear of housing 614, and so forth. For instance, selectively activated high speed output 630 can be on a same side of housing 614 as a motor of air blower apparatus 600, in at least some disclosed aspects.

In one or more embodiments, intake 618 can be an adjustable baffle intake (though not depicted as such in FIG. 6) configured to open and close in a manner suitable to selectively provide external air to or selectively remove external air from selectively activated high speed output 630. In such embodiments, intake 618 can have a radially adjustable baffle that opens and closes in a rotational fashion about a center of rotation coincident with a center of intake 618. Such a radially adjustable baffle can be embodied by a multi-piece door in the form of a ladybug closure, two (or more) generally semi-circular plates that can rotate apart or together, a rotationally variable disc defining radial slots, a set of rotational iris blades, or other suitable arrangement to permit fully open (e.g., 100%) to fully closed (e.g., 0%) air flow into intake 618 (e.g., see U.S. Pat. No. 10,299,642 B2, incorporated by reference hereinabove). In other embodiments, intake 618 can have a translating baffle with one or more openings that translate together into a closed position or translate apart into an open position. Other suitable arrangements known in the art or reasonably conveyed to one of ordinary skill in the art are deemed to be within the scope of the present disclosure.

Figure 7:
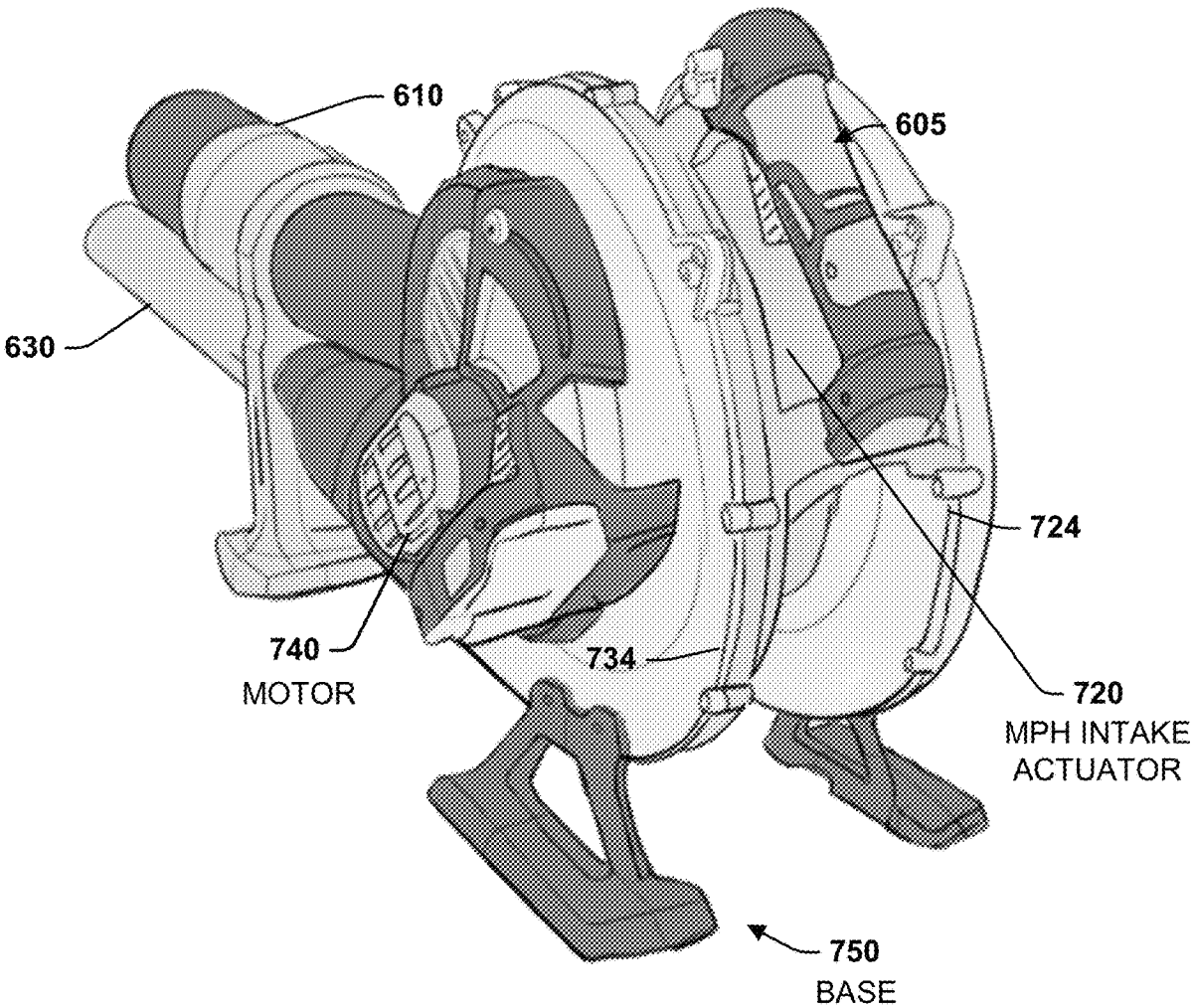
FIG. 7 illustrates a rear perspective view of the multi-output portable air blower apparatus of FIG. 6.

FIG. 7 shows a rear view of air blower apparatus 600 having a base 750 resting upon a flat surface according to further aspects of the disclosed embodiments. Housing 614 is shown to include both a MPH housing 734 and a CFM housing 724 separated by operator handle 605 and optionally a MPH intake with adjustable baffle there between (e.g., as shown in FIGS. 2-4, supra). MPH intake actuator 720 can operate to open and close MPH intake with adjustable baffle as described herein. In the embodiment depicted by FIG. 7, MPH housing 734 is fluidly coupled with selectively activated high speed output 630 at a bottom portion of MPH housing 734. Likewise, CFM housing 724 can be fluidly coupled with high volume output 610 at a bottom portion of CFM housing 724, or at a middle or central portion of CFM housing 724. A motor 740 is secured to an outer surface of MPH housing 734, though motor 740 can be moved to a different location in other aspects of the disclosed embodiments (e.g., on an outer surface of CFM housing 724, or other suitable location).

As described herein, air pressurization means can be distributed within CFM housing 724 and MPH housing 734. A coupling can connect motor 740 to air pressurization means. The coupling can be a drive shaft, in some embodiments. In other embodiments, the coupling can be one or more hydraulic pressure lines, one or more pneumatic pressure lines, one or more belt or pulley drives, one or more gear couplings, one or more piston couplings, or the like, or a suitable combination of the foregoing.

Figure 8A:
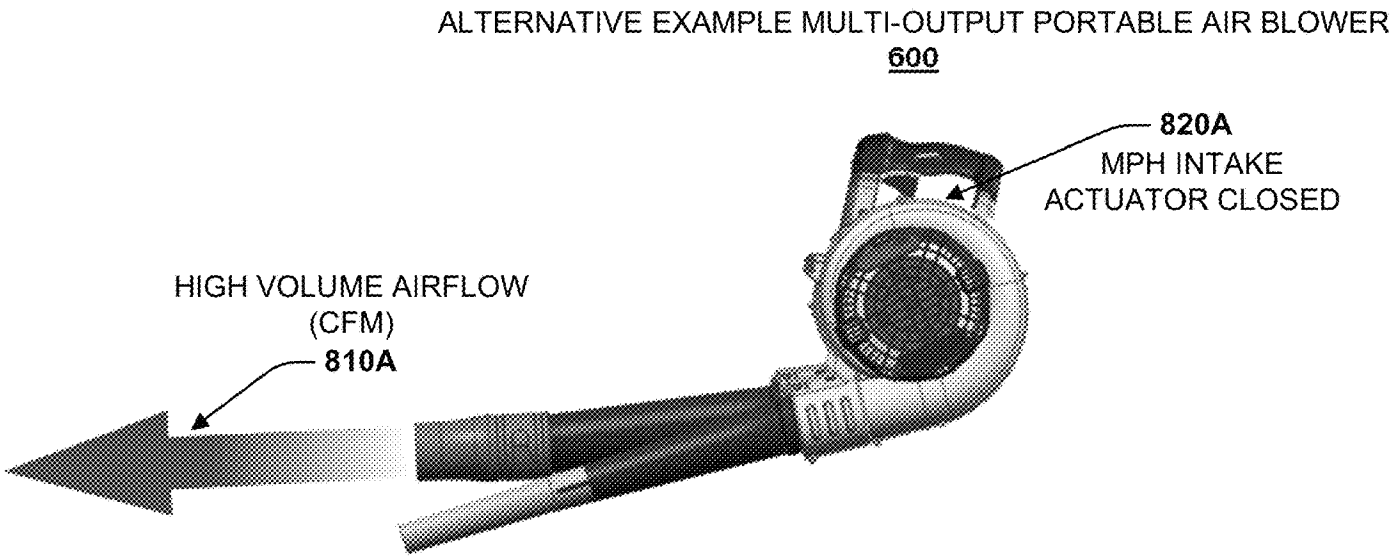
FIGS. 8A and 8B depict example illustrations of selectable activation and deactivation of high speed air output of disclosed blower apparatuses in further disclosed aspects.
Figure 8B:
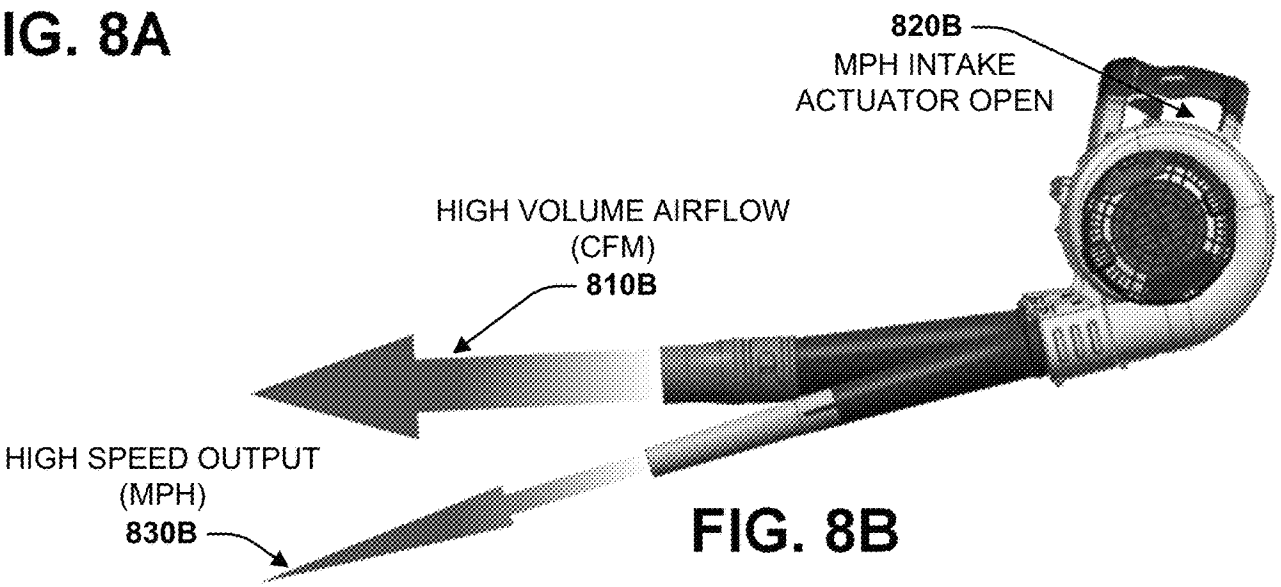

FIGS. 8A and 8B depict example air flow diagrams for air blower apparatus 600. FIG. 8A depicts an MPH intake actuator 720 in a closed position 820A. In the closed position 820A, an adjustable baffle providing air flow to MPH housing 734 is closed, preventing airflow through selectively activated high speed output 630. As a result, air blower apparatus 600 only generates high volume airflow 810A in FIG. 8A.

In contrast, FIG. 8B illustrates MPH intake actuator 720 in an open position 820B. In the open position 820B, the adjustable baffle providing air flow to MPH housing 734 is open, facilitating air pressurization means within MPH housing 734 to generate high speed output 830B through selectively activated high speed output 630, as shown. High speed output 830B is provided together with high volume airflow 810B as shown in FIG. 8B.

Figure 9:
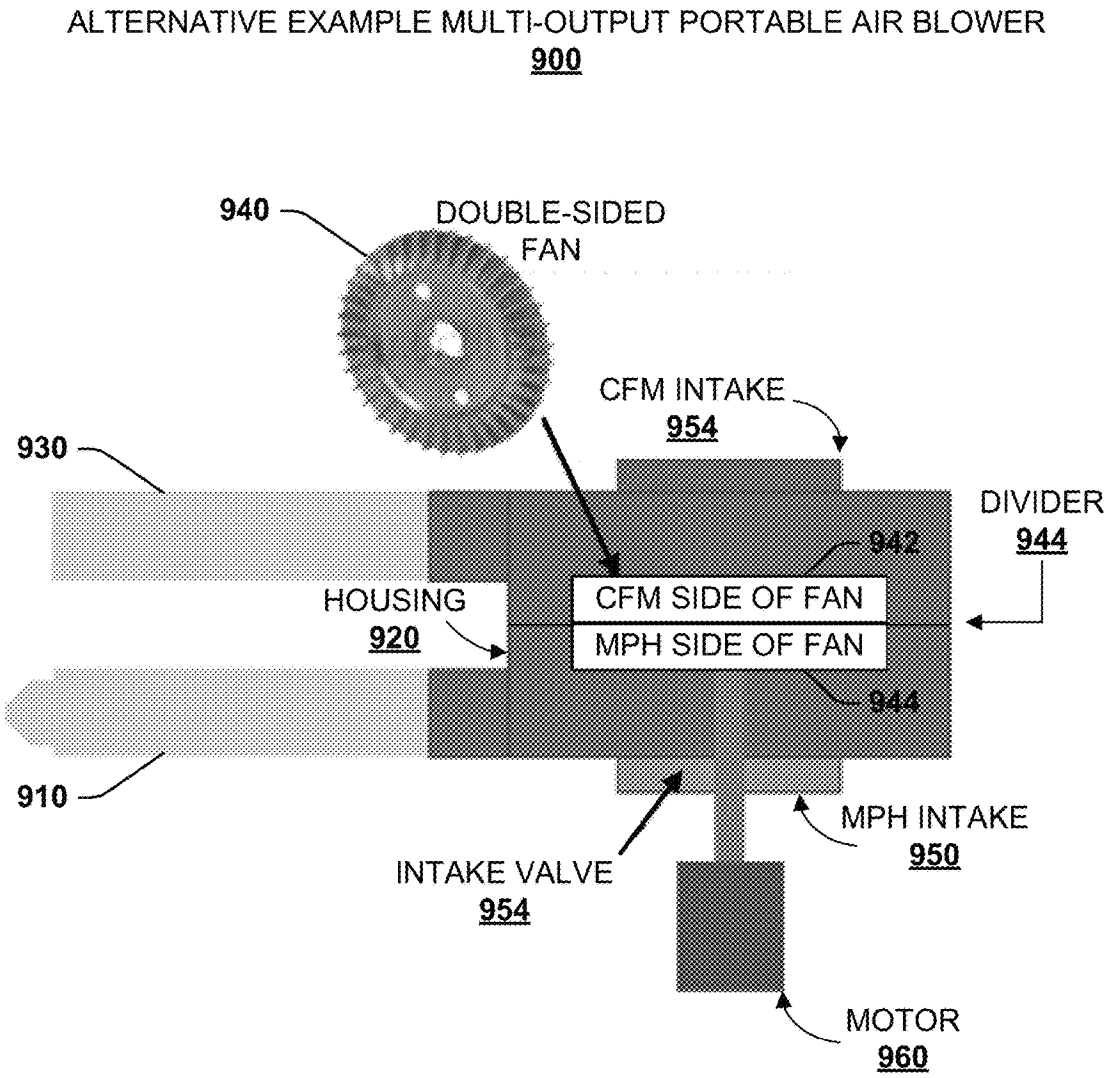
FIG. 9 depicts a block diagram of an example multi-output air blower apparatus according to still further aspects of the disclosed embodiments.

FIG. 9 depicts an alternative example multi-output portable air blower apparatus 900 according to still further aspects of the disclosed embodiments. Air blower apparatus 900 includes a housing 920 coupled to a motor 960 and a double-sided fan 940 rotationally secured within housing 920. A CFM side 942 of double-sided fan 940 is exposed to a first portion of housing 920 and a MPH side 944 of double-sided fan 940 is exposed to a second portion of housing 920, with a divider 944 (and double-sided fan 940) isolating the first portion of housing 920 from the second portion of housing 920. An MPH intake 950 can selectively open and close in response to actuation and de-actuation, respectively, of an operator-controlled intake valve 954. MPH intake 950 can selectively provide or prevent external air from accessing MPH side 944 of double-sided fan 940 and the second portion of housing 920. Separately, a CFM intake 954 can provide external air to CFM side 942 of double-sided fan 940 and the first portion of housing 920. External air received in the first portion of housing 920 comes into communication with CFM side 942, which generates pressurized air therein to provide a high volume pressurized air flow through high volume output 930. With MPH intake 950 selectively opened, external air can also be received in the second portion of housing 920 to come into communication with MPH side 944, which generates second pressurized air therein to provide a high speed pressurized air flow through high speed output 910. With MPH intake 950 selectively closed, however, external air is not received in communication with MPH side 944 and high speed output 910 has little to no airflow.

In one or more embodiments, CFM side 942 of double-sided fan 940 can have a first flute pattern on a first surface thereof exposed to the first portion of housing 920 to generate the first pressurized air within the second portion of housing 920. Likewise, MPH side 944 of double-sided fan 940 can have a second flute pattern on a second surface thereof exposed to the second portion of housing 920 to generate the second pressurized air within the second portion of housing 920. The flute pattern can vary according to length, depth, curvature or spacing about a circumference of double-sided fan 940 or a suitable combination of the foregoing. (For example, see U.S. Pat. No. 10,935,039B2 incorporated by reference hereinabove).

Figure 10:
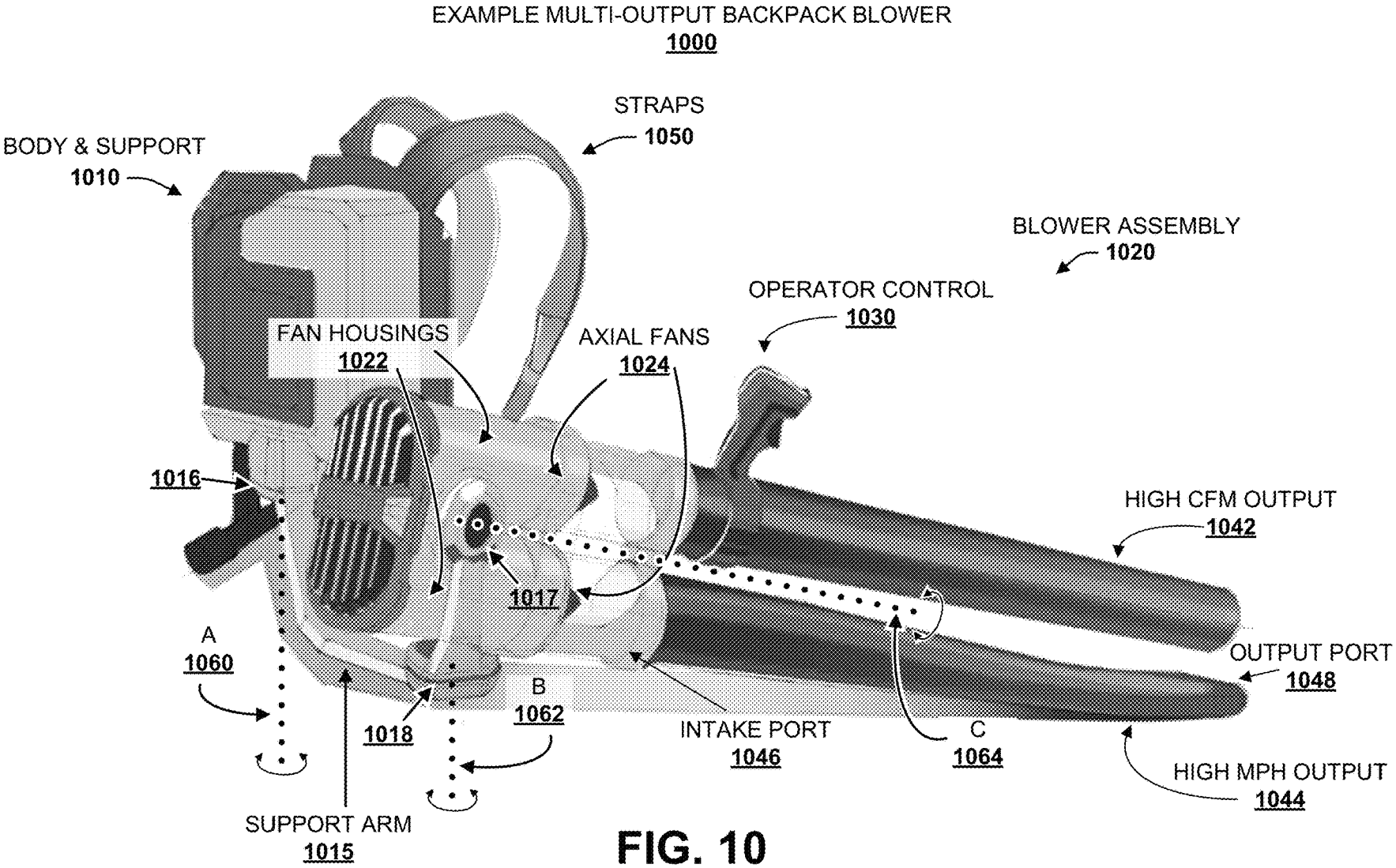
FIG. 10 depicts an example multi-output backpack-type air blower apparatus according to aspects of the present disclosure.

FIG. 10 depicts an example multi-output backpack air blower 1000 according to various aspects of the disclosed embodiments. Air blower 1000 includes a body and support 1010 that defines a rigid or at least partially rigid structure for air blower 1000. Body and support 1010 can be configured to be secured comfortably to a torso of an operator, whether in back of the operator as a back support or in the front of the operator as an abdomen support. Various padding can be secured to exterior surfaces of body and support 1010 to facilitate comfort.

Body and support 1010 can define a partially hollow interior portion (not depicted) that can house a power supply or fuel supply. Example power supplies can include an electrical battery(ies), a hydraulic motor, a pneumatic pump, and so forth. Example fuel supplies can include a gasoline tank, a diesel tank, a propane tank, a natural gas tank, etc. In some embodiments, the partially hollow interior portion can also house an electric motor, a combustion engine, and so on. In other embodiments, some or all of the power supply, fuel supply, electric motor or combustion engine can be secured to an exterior of body and support 1010 instead of contained within, and in still other embodiments some or all of the power supply, fuel supply electric motor or combustion engine can be secured to a separate component of air blower 1000 instead (e.g., to a fan housing; see below).

Air blower 1000 also includes a strap assembly 1050 secured to body and support 1010. Strap assembly 1050 can include one or more arm straps (e.g., two arm straps) that secure about shoulders and arms of an operator. In some aspects, strap assembly 1050 can be configured to secure from a back as depicted around a front of the operator. In other aspects, strap assembly 1050 can be configured to secure from a front around to a bank of the operator. In still further aspects, strap assembly 1050 can include one or more belts to secure around a waist of the operator (e.g., see belt 1560 of FIG. 15, infra). Various types of buckles, hooks, harnesses, belts, connectors, disconnectors, cords, ropes, paddings and the like, or suitable combinations thereof can be utilized for strap assembly 1050 according to various aspects of the disclosed embodiments.

Air blower 1000 can further comprise a support arm 1015 and a blower assembly 1020. Support arm 1015 can be secured at a first support coupling 1016 to body and support 1010 and secured at a second support coupling 1017 to blower assembly 1020. Support arm 1015 can be a rigid or substantially rigid structure suitable to support a mass of blower assembly 1020 at a fixed relative height with respect to body and support 1010, and optionally at a fixed distance from body and support 1010. Although first support coupling 1016 is shown secured to a bottom portion of body and support 1010, this is merely an illustrative example and in other aspects of the disclosure first support coupling 1016 can be secured to body and support 1010 at another suitable location, or at multiple locations (e.g., by way of multiple first support couplings 1016). Likewise, second support coupling 1017 is shown secured at a far side of blower assembly 1020 and near an intersection of two fan housings 1022, however, second support coupling 1017 can instead be secured at a different position on blower assembly 1020 or at multiple locations of blower assembly 1020 (e.g., by way of multiple second support couplings 1017).

In addition to the foregoing, support arm 1015 can incorporate multiple axis of rotation. In an aspect(s) of the disclosed embodiments, support arm 1015 can include axis of rotation A 1060, axis of rotation B 1062 and axis of rotation C 1064 (referred to hereinafter collectively as axis of rotation 1060-1064). However, the disclosed embodiments are not limited to this aspect(s), and in other aspects, more or fewer axis of rotation, as well as axis of rotation positioned differently than shown in FIG. 10, can be implemented with support arm 1015. As shown, axis of rotation A 1060 can be integrated with first support coupling 1016 to both secure the first end of support arm 1015 to body and support 1010 as well as facilitate rotation about axis of rotation A 1060. Additionally, axis of rotation B 1062 can be embodied by a third support coupling 1018 in aspects of the disclosed embodiments. In one or more embodiments, first support coupling 1016, second support coupling 1017 or third support coupling 1018 (referred to hereinafter collectively as: support couplings 1016-1018) can be embodied by a suitable rotary bearing, (e.g., a thrust bearing, a fluid bearing, a rolling-element bearing, a crossover bearing, a face mounted crossed roller bearing, etc.) a rotary union, a rotary bushing, or the like, or a suitable combination of the foregoing. It should be appreciated that respective support couplings 1016-1018 can be embodied by different rotary structures, the same rotary structure, and so forth.

Support arm 1015 can maintain blower assembly 1020 at a right side of body and support 1010 as part of a right-handed operation, as shown in FIG. 10. Axis of rotation 1060-1064 can be operable to maintain blower assembly 1020 at the right side of body and support 1010 absent a force suitable to overcome a mechanical resistance of support couplings 1016-1018, or absent unlocking of one or more of support couplings 1016-1018, or the like. When suitably activated, axis of rotation 1060-1064 can facilitate rotation of blower assembly 1020 from the right side of body and support 1010 to a left side of body and support 1010 for a left-handed operation (e.g., see FIG. 12, infra). Moreover, axis of rotation 1016-1018 can facilitate rotation of blower assembly 1020 between the left side of body and support 1010 and the right side of body and support 1010, and optionally locking and unlocking blower assembly 1020 into and out from the right-handed operation at the right side of body and support 1010 and the left-handed operation at the left side of body and support 1010, according to various embodiments of the present disclosure.

Blower assembly 1020 can comprise multiple fan housings 1022, including a first fan housing and a second fan housing. In aspects of the disclosed embodiments illustrated in FIG. 10, fan housings 1022 are axial fan housings enclosing respective axial fans 1024. Axial fans can be powered by a motor(s) (not depicted) in response to activation of operator control 1030 to rotate within respective fan housings 1022 and generate air pressure to drive respective airflows (e.g., a first airflow and a second airflow) out from respective airflow outputs. Shown in FIG. 10 are a high volume (cubic feet per meter: CFM) output 1042 and a high speed (miles per hour: MPH) output 1044 (referred to hereinafter collectively as: airflow outputs 1042, 1044).

Airflow outputs 1042, 1044 facilitate transfer of respective airflows from fan housings 1022 to output ports 1048 of airflow outputs 1042, 1044. In addition, the respective airflows can have at least one different fluid dynamic characteristic, such as different relative volumetric airflow, different relative airflow speed, different relative airflow energy, or the like, or a suitable combination of the foregoing. Different fluid dynamic characteristics can be achieved utilizing different geometries at output port 1048 (or different geometries at an intake port 1046), different blade/fin structure for respective axial fans 1024, different rotation speed for respective axial fans 1024, different input power for respective axial fans 1024, or different geometry for respective fan housings 1022 and fans contained therein (e.g., see FIG. 11, infra), or the like, or a suitable combination of the foregoing. In one aspect, output port 1048 (or intake port 1046) of high speed output 1044 can have a lower cross-sectional area than high volume output 1042 to cause a higher speed and lower volume airflow dynamic at output port 1048 of high speed output 1044 compared with high volume output 1042. In another aspect, a geometry of a first fan housing or a first axial fan associated with high volume output 1042 can generate a larger airflow volume than a second fan housing and second axial fan associated with high speed output 1044. In yet another aspect, a blade or fin structure of the first axial fan can differ from a blade or fin structure of the second axial fan to achieve a higher relative volume airflow through high volume output 1042 compared with high speed output 1044. In a further aspect, a rotation speed of the first axial fan can differ from a rotation speed of the second axial fan to achieve a higher relative volume airflow through high volume output 1042 compared with high speed output 1044. In still further aspects, a geometry or style of the first fan housing and an associated fan can differ from the second fan housing and associated fan to achieve the higher volume airflow at high volume output 1042 and the higher speed airflow at high speed output 1044. Moreover, any suitable combination of the foregoing can be provided for blower assembly 1020 to achieve a higher volume airflow at high volume output 1042 compared to high speed output 1044, and a higher speed airflow at high speed output 1044 compared to high volume output 1042.

As shown, high volume output 1042 and high speed output 1044 can be provided in adjacent position relative to one another and substantially parallel in length. Moreover, the high speed output can be positioned below the high volume output for right-handed and left-handed operation (e.g., see FIG. 12, infra). High speed output 1044 can provide additional energy to assist high volume output 1042 in moving debris, dirt, leaves, grass and vegetation clippings, and the like on a surface. For instance, a high speed airflow can be preferable to lift or dislodge heavier material such as wet or compressed vegetation upward into an airflow path of high volume output 1042. In some disclosed embodiments, the high speed airflow can be selectively activated and deactivated by an operator. This can be accomplished by selective activation/deactivation of the second axial fan within the second fan housing by operator control 1030 independent of operation of the first axial fan within the first fan housing. This allows an operator to deploy the high speed airflow through high speed output 1044 when desired, and to preserve fuel or optimize power consumption of air blower 1000 when not desired.

In at least one embodiment, high volume output 1042 can have a first output port 1048 with a first surface area and high speed output 1044 can have a second output port 1048 with a second surface area. In various aspects of the disclosed embodiments, the second surface area can be smaller than the first surface area. Moreover, a first intake port 1046 of high volume output 1042 can have the same or similar surface area as a second intake port 1046 of high speed output 1044. High speed output 1030 can therefore narrow in surface area as it extends from the second fan housing 1022 at the second intake port 1046 to the second output port 1048 more than high volume output 1042 narrows from the first fan housing 1022 to the first output port 1048.

Figure 11:
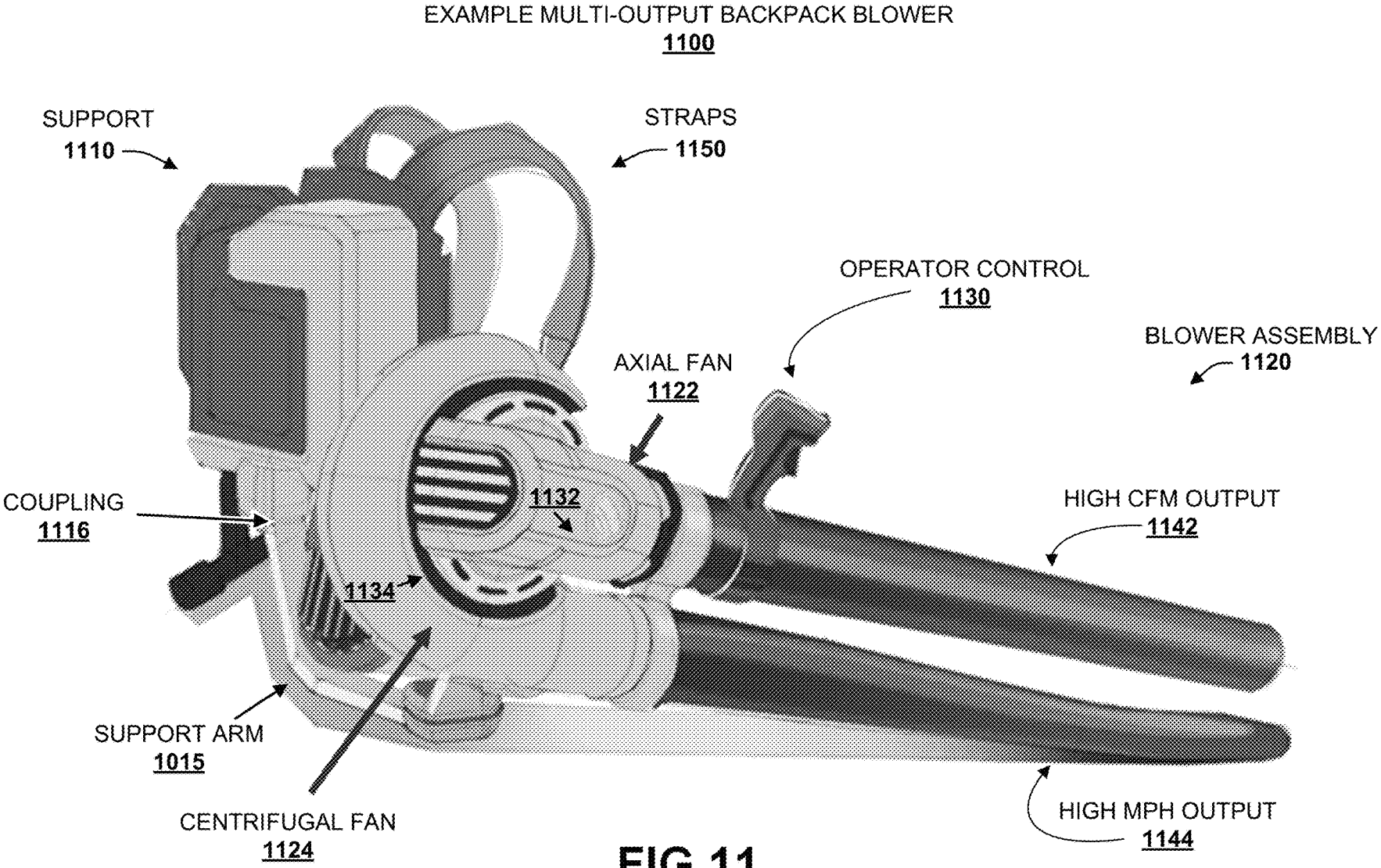
FIG. 11 illustrates a multi-output backpack-type air blower apparatus with axial and centrifugal fans according to aspects of the present disclosure.

FIG. 11 illustrates a multi-output backpack air blower 1100 according to alternative aspects of the disclosed embodiments. Air blower 1100 can be substantially similar to air blower 1000 in at least some disclosed embodiments, however, the subject disclosure is not so limited and air blower 1100 can differ from air blower 1000 in one or more elements. As shown, air blower 1100 can comprise a support structure 1100 and straps secured to support structure 1110 for fastening air blower 1100 to a torso of an operator. Additionally, a support arm 1015 is provided to secure a blower assembly 1120 to support structure 1100 at an at least one support coupling 1116. Support coupling(s) 1116 can be a fixed coupling or a rotatable coupling as described herein. One or more additional support couplings (optionally rotatable) can be provided with support arm 1015 in various aspects of the disclosed embodiments.

Blower assembly 1120 can comprise an axial fan 1122 in an axial fan housing 1132 and can also comprise a centrifugal fan 1124 in a centrifugal fan housing 1134. Axial fan housing 1132 can define an output port in fluid communication with an intake port of a high volume output 1142. Air pressure generated by activation of axial fan 1122 within axial fan housing 1132 can result in a first airflow received at the intake port of high volume output 1142 and conveyed to an output port thereof. Likewise, centrifugal fan housing 1134 can define an output port in fluid communication with an intake port of a high speed output 1144. Air pressure generated by activation of centrifugal fan 1124 within centrifugal fan housing 1134 can result in a second airflow received at the intake port of high speed output 1144 and conveyed to an output port thereof. In various embodiments, the first airflow can have at least one different fluid dynamic characteristic than the second airflow (e.g., as described above with respect to FIG. 10, supra). The different fluid dynamic characteristic(s) can result from action of centrifugal fan 1124 within centrifugal fan housing 1134, power consumed by centrifugal fan 1124, a surface area of high speed output 1144, or the like, or a suitable combination of the foregoing, as compared with the action of axial fan 1122 within axial fan housing 1132, power consumed by axial fan 1122 or surface area of high volume output 1142, and so forth.

In an embodiment, axial fan 1122 and centrifugal fan 1124 can be activated by operator control 1130 separately or activated together. In another embodiment, axial fan 1122 and centrifugal fan 1124 can be deactivated by operator control 1130 separately or deactivated together. For instance, axial fan 1122 can be activated while centrifugal fan 1124 is deactivated; centrifugal fan 1124 can be activated while axial fan 1122 is deactivated, or both axial fan 1122 and centrifugal fan 1124 can be activated together and deactivated together.

In further embodiments, axial fan housing 1132 or centrifugal fan housing 1134 can have an intake that can be selectively baffled and unbaffled. A selectively baffled intake can isolate an interior of axial fan housing 1132 or centrifugal fan housing 1134 from external air, effectively suppressing or terminating an airflow output of high volume output 1142 or high speed output 1144, respectively. A baffled intake also significantly reduces drag on axial fan 1122 or centrifugal fan 1124, lowering power consumption. The selectively baffled intake can be implemented where axial fan 1122 and centrifugal fan 1124 are powered by a single motor and motor drive mechanism to operate together or not operate together. This allows an operator (e.g., via operator controls 1130 or by manual actuation of an intake baffle) to effectively select between dual airflow operation utilizing the first airflow and the second airflow and single airflow operation utilizing either the first airflow or the second airflow. This allows an operator to reduce power consumption when dual airflow operation is not required, and in embodiments where axial fan 1122 and centrifugal fan 1124 are not independently activated and deactivated.

Figure 12:
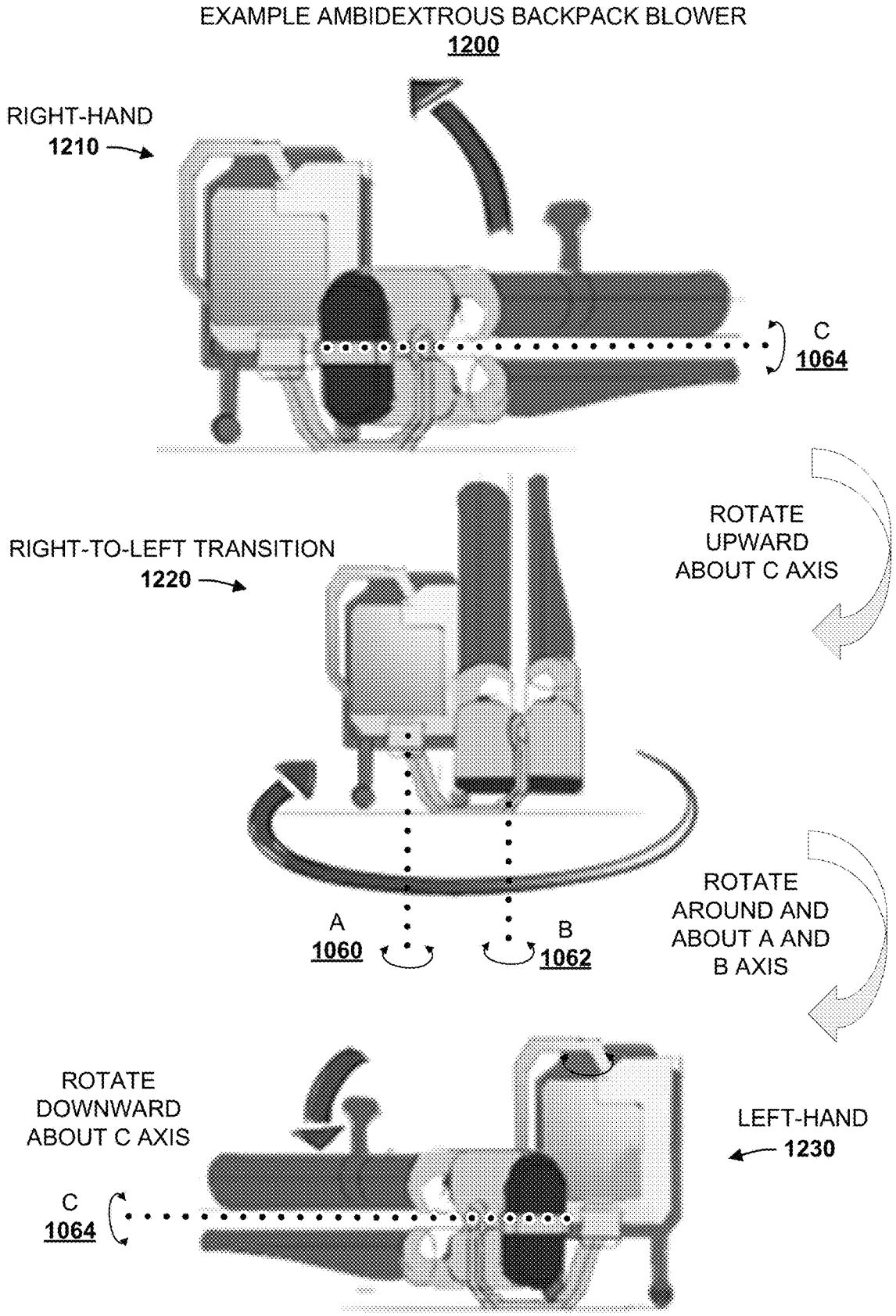
FIG. 12 depicts an example backpack air blower with an ambidextrous output platform, according to further aspects disclosed herein.

FIG. 12 depicts an example ambidextrous operation of a disclosed backpack air blower 1200 according to alternative or additional embodiments of the present disclosure. At the top of FIG. 12, air blower is shown in a right-hand 1210 configuration with a blower assembly on a ride side of air blower 1200. An example ambidextrous operation begins with rotating the blower assembly upward about axis of rotation C 1064 (e.g., see FIG. 10, supra) to rotate output ports of the blower assembly vertically above respective fan housings, as shown in right-to-left transition 1220. The example ambidextrous operation continues with rotating the blower assembly about axis of rotation A 1060 and about axis of rotation B 1062 as shown, resulting in the blower assembly on a left side of air blower 1200 with output ports thereof still vertical as depicted in right-to-left transition 1220. To finalize left-hand 1230 configuration the blower assembly is rotated downward about axis of rotation C 1064 to direct the output ports of the blower assembly at a suitable target (e.g., downward to a surface) in front of air blower 1200. It should be appreciated that the order of rotation of the example ambidextrous operation shown in FIG. 12 is exemplary only and is not intended to limit the means by which the blowing assembly can transition from right-hand 1210 orientation to left-hand 1230 orientation. For instance, the blower assembly can first be rotated about axis of rotation A 1060 and then rotated about axis of rotation B 1062 to move the blower assembly to a left side of air blower 1200, without rotating about axis of rotation C 1064. Alternatively, the blower assembly can first be rotated about axis of rotation B 1062 to position the output ports of the blower assembly to the rear, then rotated about axis of rotation C 1060 to position the blower assembly on the left side of air blower 1200 with output ports facing forward. Other variations known or reasonably conveyed to one of ordinary skill in the art by way of the context provided herein are considered within the scope of the present disclosure.

Figure 13:
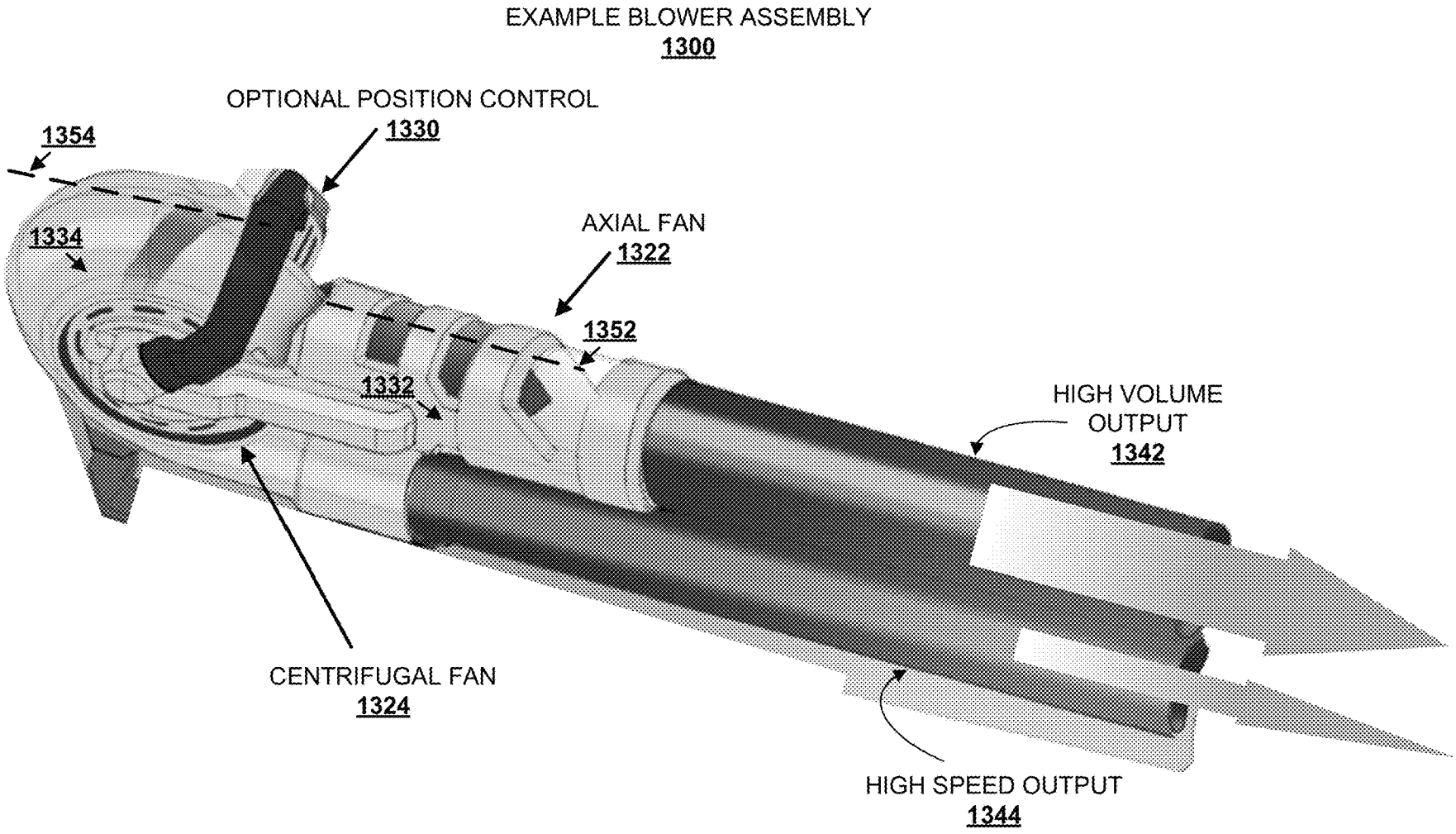
FIG. 13 illustrates a multi-output blower platform with centrifugal fan and axial fan for a backpack-style or portable air blower, in further aspects of the disclosed embodiments.

FIG. 13 depicts an example blower assembly 1300 according to other aspects of the disclosed embodiments. Blower assembly 1300 can be part of a backpack style air blower as disclosed herein or known in the art (e.g., see FIG. 10 or 11, supra, or FIG. 15 or 16, infra). Alternatively, blower assembly 1300 can be part of a handheld portable air blower apparatus in still other aspects of the disclosed embodiments (e.g., see FIG. 17, infra).

Blower assembly 1300 includes an axial fan housing 1332 enclosing an axial fan 1322 adjacent to a centrifugal fan housing 1334 enclosing a centrifugal fan 1324. A high volume output 1342 transfers an airflow generated by axial fan 1322 toward an output of blower assembly 1300, and likewise a high speed output 1344 transfers a second airflow generated by centrifugal fan 1324 toward the output of blower assembly 1300. In addition, axial fan housing 1332 can be positioned with respect to centrifugal fan housing 1334 to achieve a symmetric weight distribution of the centrifugal fan housing 1334 (and centrifugal fan 1324) and the axial fan housing 1332 (and axial fan 1322). For example, axial fan housing 1332 can be positioned such that a centerline 1352 of axial fan housing 1332 is coplanar or substantially coplanar with a centerline 1354 of centrifugal fan housing 1334. This can provide symmetric weight balance of blower assembly 1300 out of operation, as well as in operation. For instance, centrifugal forces generated by rotation of centrifugal fan 1324 and axial fan 1322 can also be (substantially) coplanar, minimizing resulting shear forces and improving operator comfort, reducing wear on support couplings (e.g., see FIG. 10), and so forth.

As shown, axial fan housing 1332 can be positioned forward of centrifugal fan housing 1324 along a length of blower assembly 1300. This allows a length of high volume output 1342 to be shorter than that of high speed output 1344. Additionally, this optionally permits rotation of high volume output 1342 relative to high speed output 1344 about a suitable axis of rotation by way of an optional position control 1330, as shown in more detail in FIG. 14. In such embodiment(s), an operator can adjust direction of high volume output 1342 relative to high speed output 1344 within a range of directions permitted by operation position control 1330.

Figure 14:
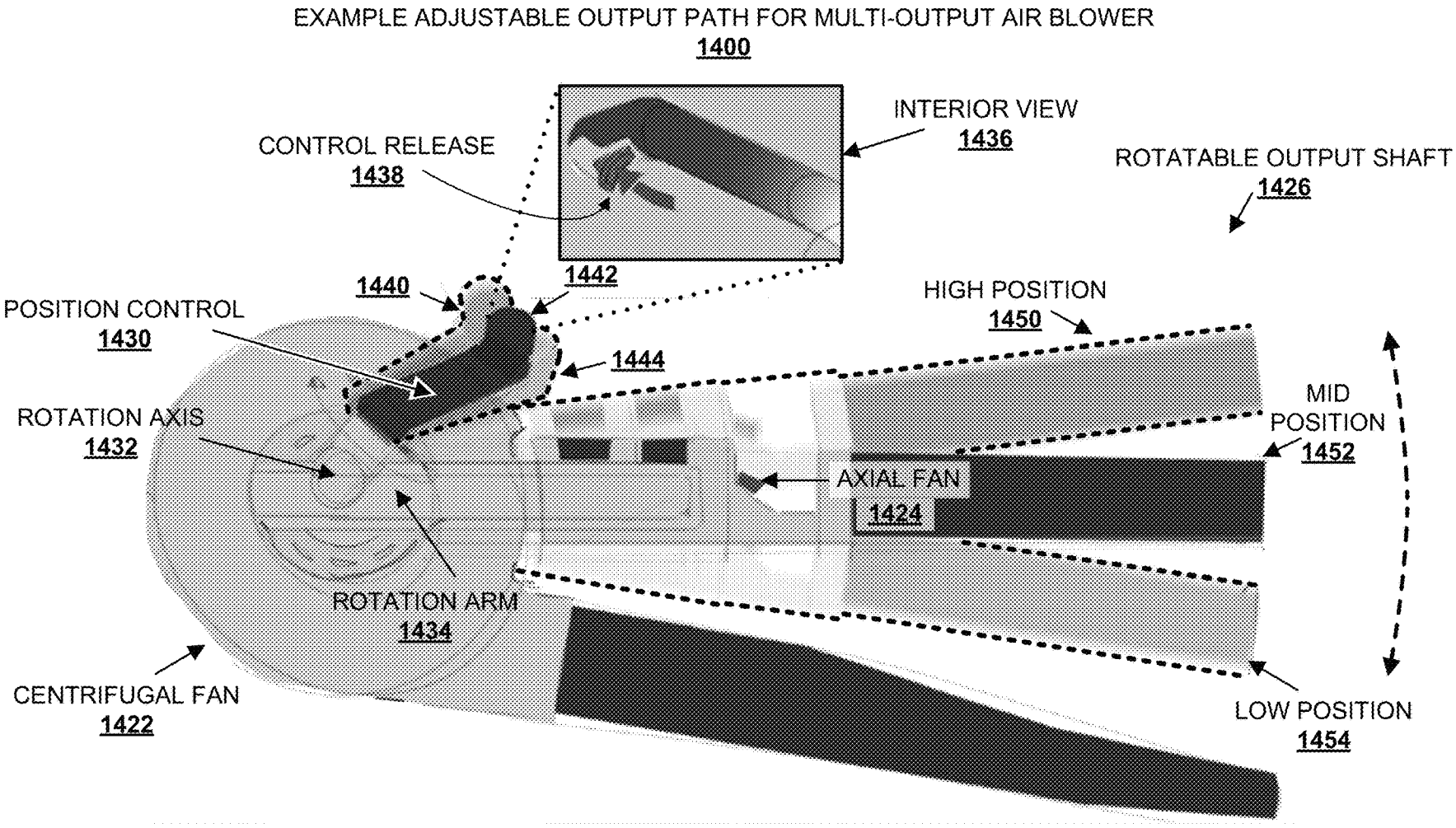
FIG. 14 depicts an example multi-output portable air blower apparatus and rotatable linkage to change orientation of an airflow output of the multi-output.

FIG. 14 provides an example drawing of a blower apparatus 1400 according to still further embodiments of the present disclosure. For instance, blower apparatus 1400 provides an adjustable output shaft about an axis of rotation. This enables an operator to increase or decrease angular rotation between a first output shaft and a second output shaft.

Blower apparatus 1400 can comprise a centrifugal fan 1422 and centrifugal housing and an axial fan 1424 and axial housing similar to that shown in FIG. 13, supra. Additionally, the axial fan housing can be secured to a rotation axis 1432 near a center of the centrifugal fan housing through a rotation arm 1434. Rotation of the axial fan housing about rotation axis 1432 facilitates movement of a rotatable output shaft 1426 secured to the axial fan housing. This enables an operator to move rotatable output shaft 1426 to multiple positions, including a low position 1454, a mid position 1452 and a high position 1450 as shown. These positions can be set in response to movement of a position control 1430, and associated low 1444, mid 1442 and high 1440 positions of position control 1430. The cutout shows an illustration of an interior view 1436 and an example control release 1438 locking position control 1430 in one of low position 1440, mid position 1442 and high position 1440, and releasing position control 1430 from any of the locked positions.

Figure 15:
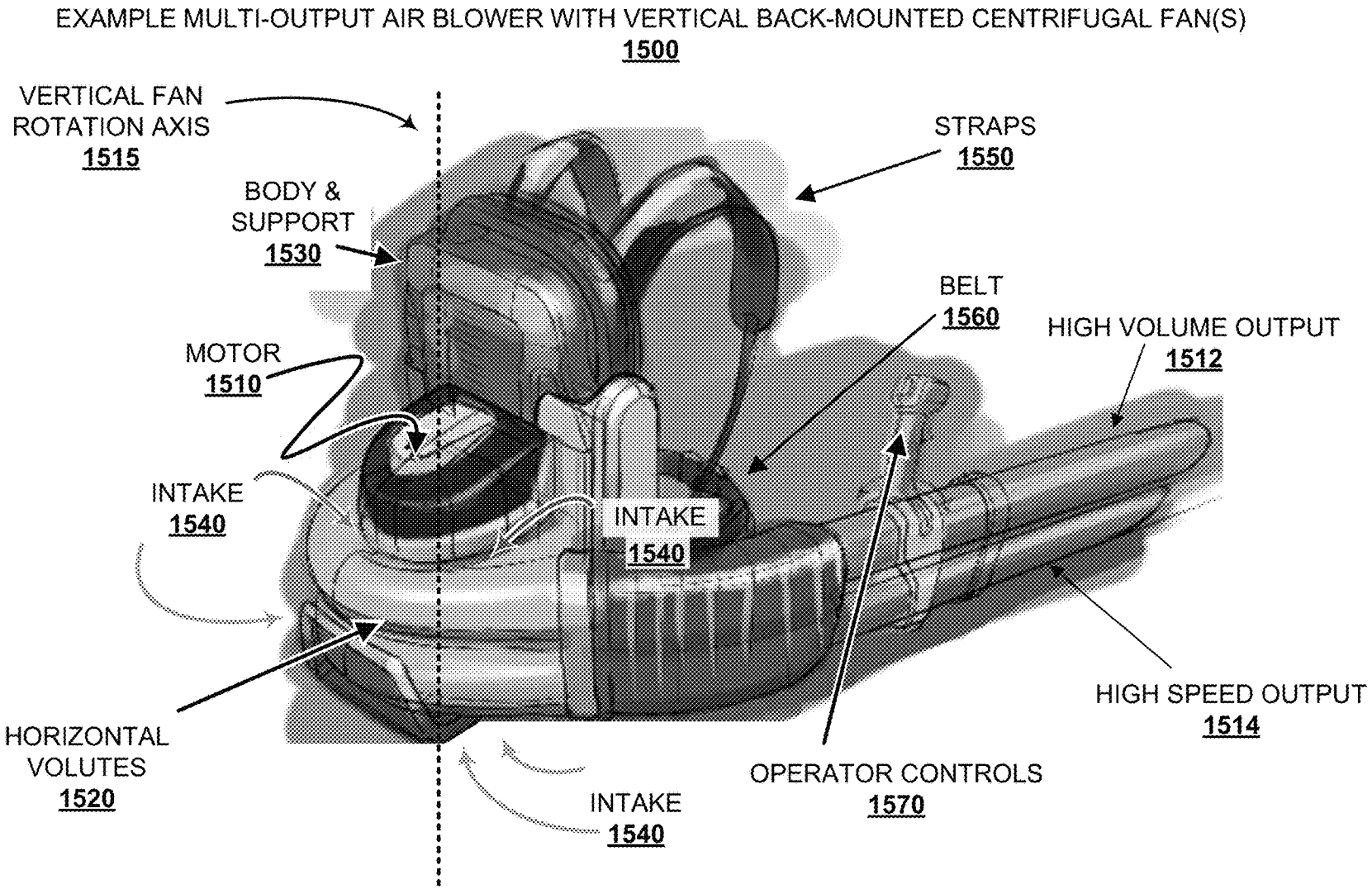
FIG. 15 illustrates an example multi-output portable air blower apparatus with dual centrifugal fan housings in a vertical arrangement, according to further aspects.

FIG. 15 shows an example multi-output backpack air blower 1500 with vertical back-mounted centrifugal fan(s), in additional embodiments of the present disclosure. Air blower 1500 comprises a body and support 1530 that gives structural support for air blower 1500. Further, a motor 1510 is secured to a surface of the body and support 1530 on an opposite side from a strap assembly 1550 and a belt 1560. Adjacent motor 1510 is a housing enclosing one or more fans that rotate about a vertical fan rotation axis 1515. The fans can be centrifugal fans mounted vertically within the housing respect to each other along vertical fan rotation axis 1515. In an embodiment, the fan housing can define a plurality of fan housing interiors in a common exterior casing (e.g., see also FIG. 19, infra) in which respective centrifugal fans are enclosed and define airflow outputs as horizontal volutes 1520. In another embodiment, the fan housing can comprise a plurality of separate adjacent fan housings with separate exterior casings mounted vertically with respect to each other along vertical fan rotation axis 1515, and respectively housing one of the centrifugal fans. Horizontal volutes are in fluid communication with respective intake ports of a high volume output 1512 and a high speed output 1514.

Motor 1510 can be an electric motor, a combustion engine, or the like. Operator controls 1570 can activate or deactivate the motor to drive rotation of fans within the fan housing(s). Intake ports 1540 defined in the fan housing(s) facilitate provisional of external air into fluid communication with the centrifugal fans to generate respective airflows that exit the fan housing(s) through horizontal volutes 1520 and respective high volume output 1512 and high speed output 1514. In some embodiments, an intake 1540 to one fan housing interior (or fan housing) can be selectively baffled to restrict airflow to one centrifugal fan located within the one fan housing interior. Baffling can be engaged at operator controls 1570 in conjunction with a second motor (not depicted) connected to the selective baffling, or the selective baffling can be manually opened or closed by an operator.

Figure 16:
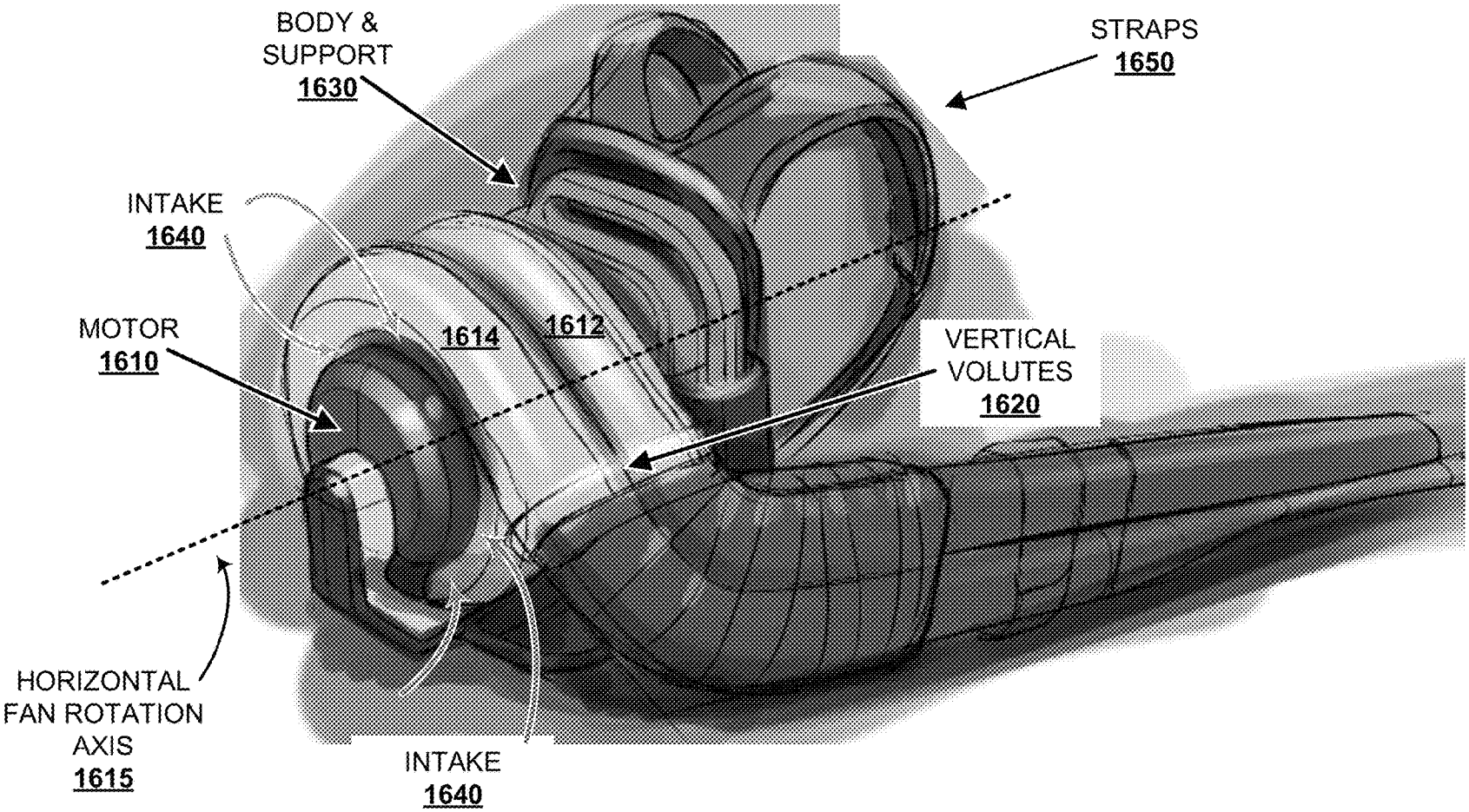
FIG. 16 illustrates an example multi-output portable air blower apparatus with dual centrifugal fan housings in a horizontal arrangement, in still additional aspects.

FIG. 16 depicts an example multi-output backpack air blower 1600 with horizontal back-mounted centrifugal fan(s), in still further embodiments of the present disclosure. Air blower 1600 comprises a body and support 1630 that gives structural support for air blower 1600. A motor 1610 is secured at an end of a fan housing (or a stack of fan housings). The fan housing can define multiple fan housing interiors (e.g., with a common exterior casing) stacked along a horizontal fan rotation axis 1615. The fan housing interiors can enclose respective centrifugal fans, or a single dual-sided fan at an intersection of the fan housing interiors (e.g., see FIG. 19, infra), with one side of the dual-sided fan fluidly engaged with a first fan housing interior and a second side of the dual-sided fan fluidly engaged with a second fan housing interior. In another embodiment, the fan housing can comprise separate fan housings (with respect fan housing casings) secured horizontally with respect to each other along horizontal fan rotation axis 1615. Rotation of the fan(s) generates a plurality of airflows within the fan housing(s) that exit through vertical volutes 1620 and out respective high volume and high speed outputs as described herein. One or more intakes 1640 provide external air to the fan housing(s). In an embodiment, one intake 1640 can be selectively baffled to selectively suppress one airflow of air blower 1600 and reduce power consumption at motor 1610 where the suppressed airflow is not required by an operator.

Figure 17:
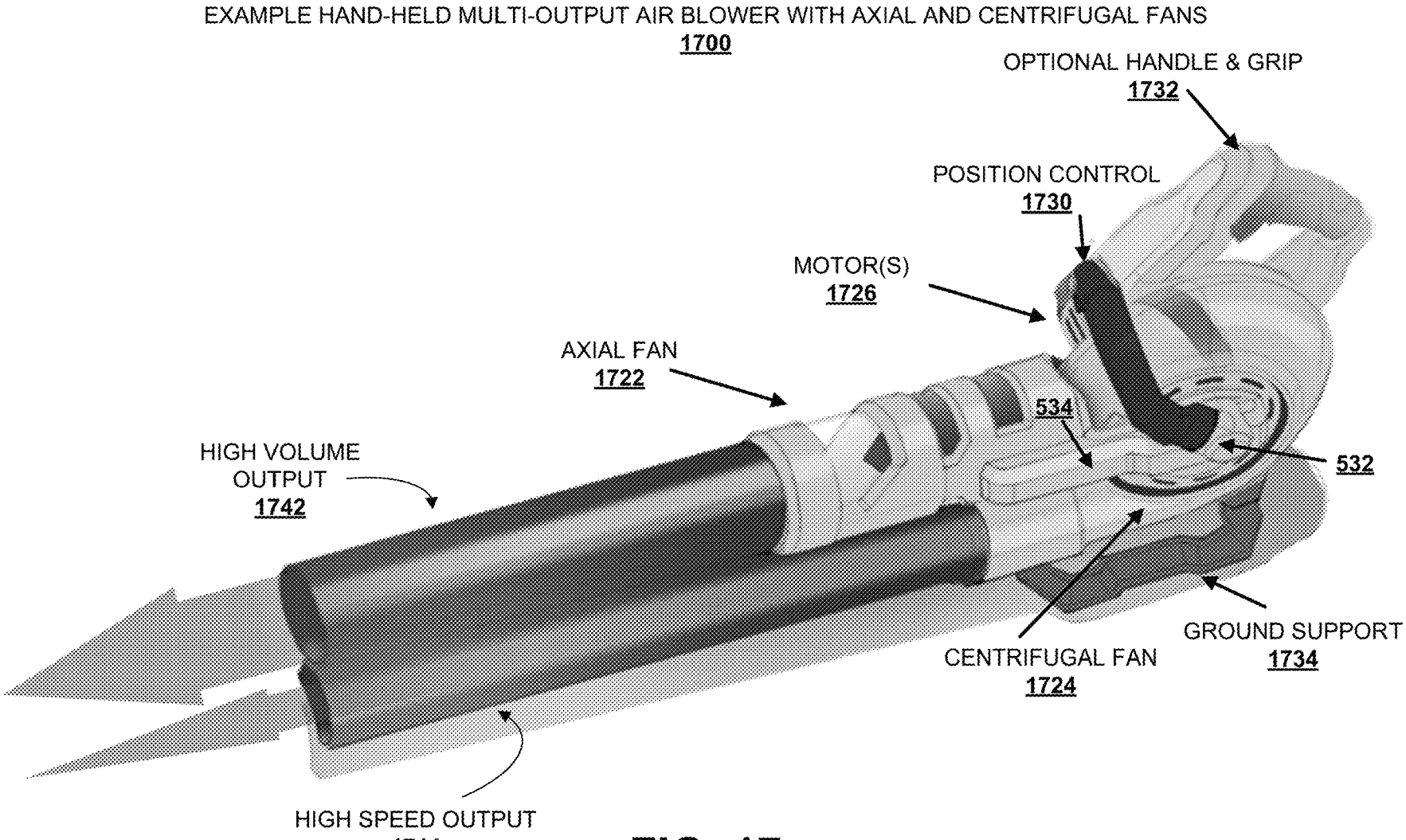
FIG. 17 depicts an example portable multi-output air blower with rotatable fan housing and airflow output, in additional disclosed aspects.

FIG. 17 shows a drawing of a portable air blower 1700 with an axial and centrifugal fan according to additional embodiments of the present disclosure. Portable air blower 1700 can be configured for hand-held operation by an operator. An optional handle and grip 1732 are provided at a top side of portable air blower 1700, and a ground support 1734 is secured to a bottom side of portable air blower 1700 to support portable air blower 1700 upon a surface.

Portable air blower 1700 can have one or more motors 1726 that power a centrifugal fan 1724 within a centrifugal fan housing and an axial fan 1722 within an axial fan housing. In some embodiments, portable air blower 1700 can have a first motor and first motor drive to power centrifugal fan 1724, and can have a second motor and second motor drive to power axial fan 1722. In other embodiments, portable air blower 1700 can have a single motor and a first motor drive that mechanically powers centrifugal fan 1724 and a second motor drive (e.g., extended from the first motor drive) that mechanically powers axial fan 1722.

Axial fan 1722 can generate a first airflow that flows through a high volume output 1742. Underlying high volume output 1742 is a high speed output 1744 that receives airflow generated by centrifugal fan 1724. In an embodiment, the axial fan housing and high volume output can be rotated between multiple positions by way of a position control 1730, and a rotation arm 1434 secured to a rotation axis 1432. In another embodiment, operator controls (not depicted) can activate and deactivate motor(s) 1726 to power axial fan 1722 and centrifugal fan 1724. In at least one aspect of the embodiments, the operator controls can independently activate or deactivate axial fan 1722 and centrifugal fan 1724 to selectively generate one airflow, two airflows, or no airflow. In still other embodiments, centrifugal fan can be selectively baffled to suppress an airflow out from high speed output 1744, allowing an operator to generate a high volume airflow through high volume output 1742 and a high speed airflow through high speed output 1744, or only the high volume airflow through high volume output 1742.

Figure 18:
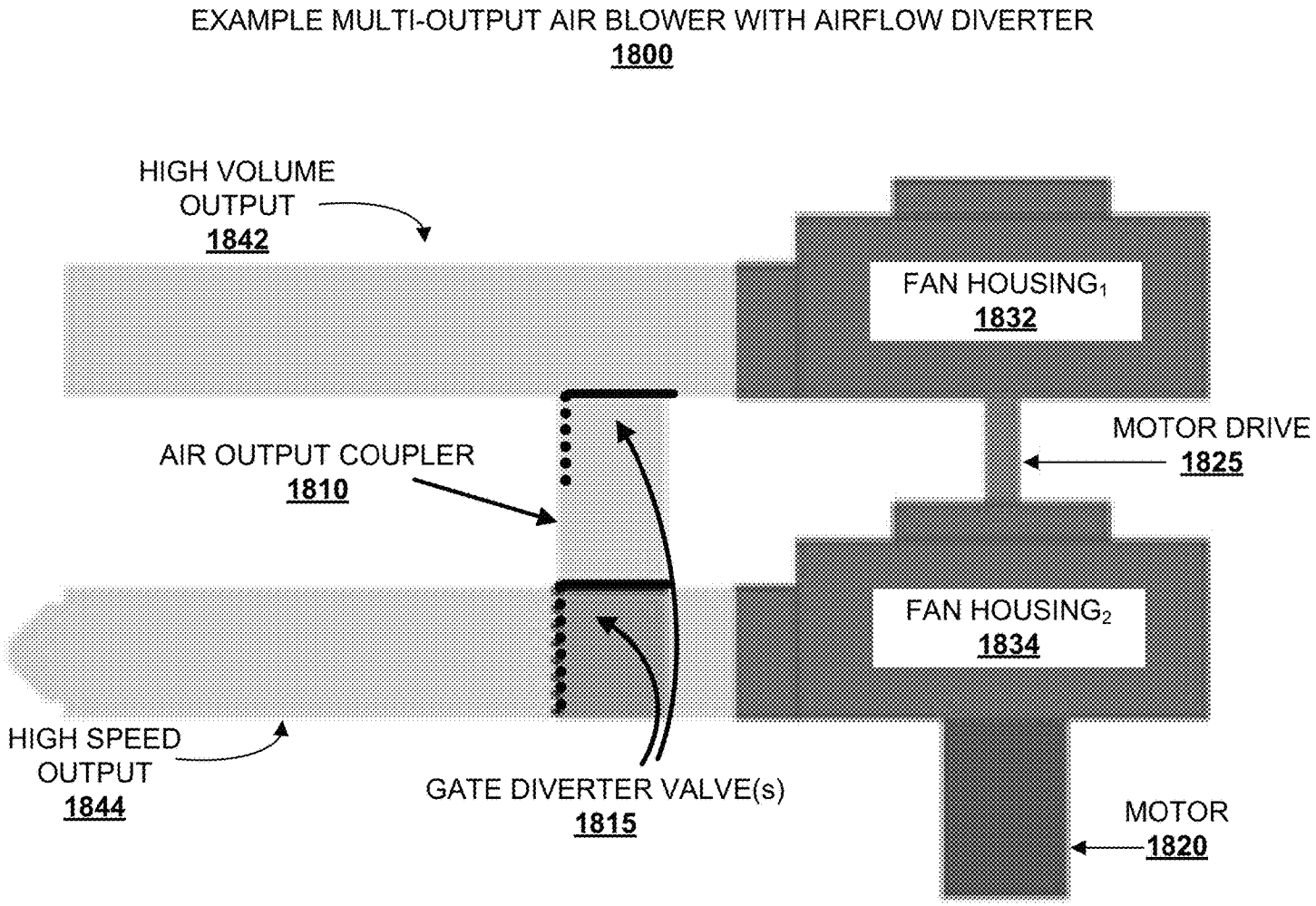
FIG. 18 depicts an example multi-output air blower apparatus with diverter valve, according to still further aspects of the disclosed embodiments.

FIG. 18 depicts an example multi-output air blower 1800 with airflow diverter, according to alternative or additional embodiments of the present disclosure. Air blower 1800 can comprise a first fan housing: fan housing$_1$ 1832 and a second fan housing: fan housing$_2$ 1834 (referred to collectively as fan housings 1832-1834). Fan housings 1832-1834 enclose respective fans powered by a motor 1820 and driven by a common motor drive 1825. Fan housing$_1$ 1832 defines an output in fluid communication with an intake port of a high volume output 1842, whereas fan housing$_2$ 1834 defines a second output in fluid communication with a second intake port of a high speed output 1844. Furthermore, an air output coupler 1810 interconnects high volume output 1842 with high speed output 1844. Moreover, a gate diverter valve 1815 is positioned at an intersection at least of high speed output 1844 and air output coupler 1810. Gate diverter valve 1815 can be configured to move between a first position and a second position. In the first position, gate diverter valve 1815 closes the intersection of high speed output 1844 and air output coupler 1810 to airflow, and instead drives airflow from fan housing$_2$ 1834 through an output port of high speed output 1844. In a second position, gate diverter valve 1815 closes the output port of high speed output 1844 to airflow, and drives airflow from fan housing$_2$ 1834 through air output coupler 1810 into high volume output 1842 to join an airflow from fan housing$_1$1832. The combined airflows from fan housing$_2$1834 and fan housing$_1$ 1832 are then driven through an output port of high volume output 1842.

In at least one embodiment, gate diverter valve 1815 can comprise a mechanical airflow switch (e.g., a flap, or the like) at the intersection of high speed output 1844 and air output coupler 1810 and a second mechanical airflow switch at a second intersection of high volume output 1842 and air output coupler 1810. In this embodiment, the second mechanical airflow switch can close the second intersection of high volume output 1842 and air output coupler 1810 concurrent with the mechanical airflow switch closing the intersection of high speed output 1844 and air output coupler 1810. This directs airflow from fan housing$_1$ 1832 through high volume output 1842 while minimizing impact on that airflow resulting from an open intersection at air output coupler 1810 and high volume output 1842. Likewise, when the mechanical airflow switch opens the intersection of high speed output 1844 and air output coupler 1810, the second mechanical airflow switch can open the intersection of high volume output 1842 and air output coupler 1810.

Figure 19:
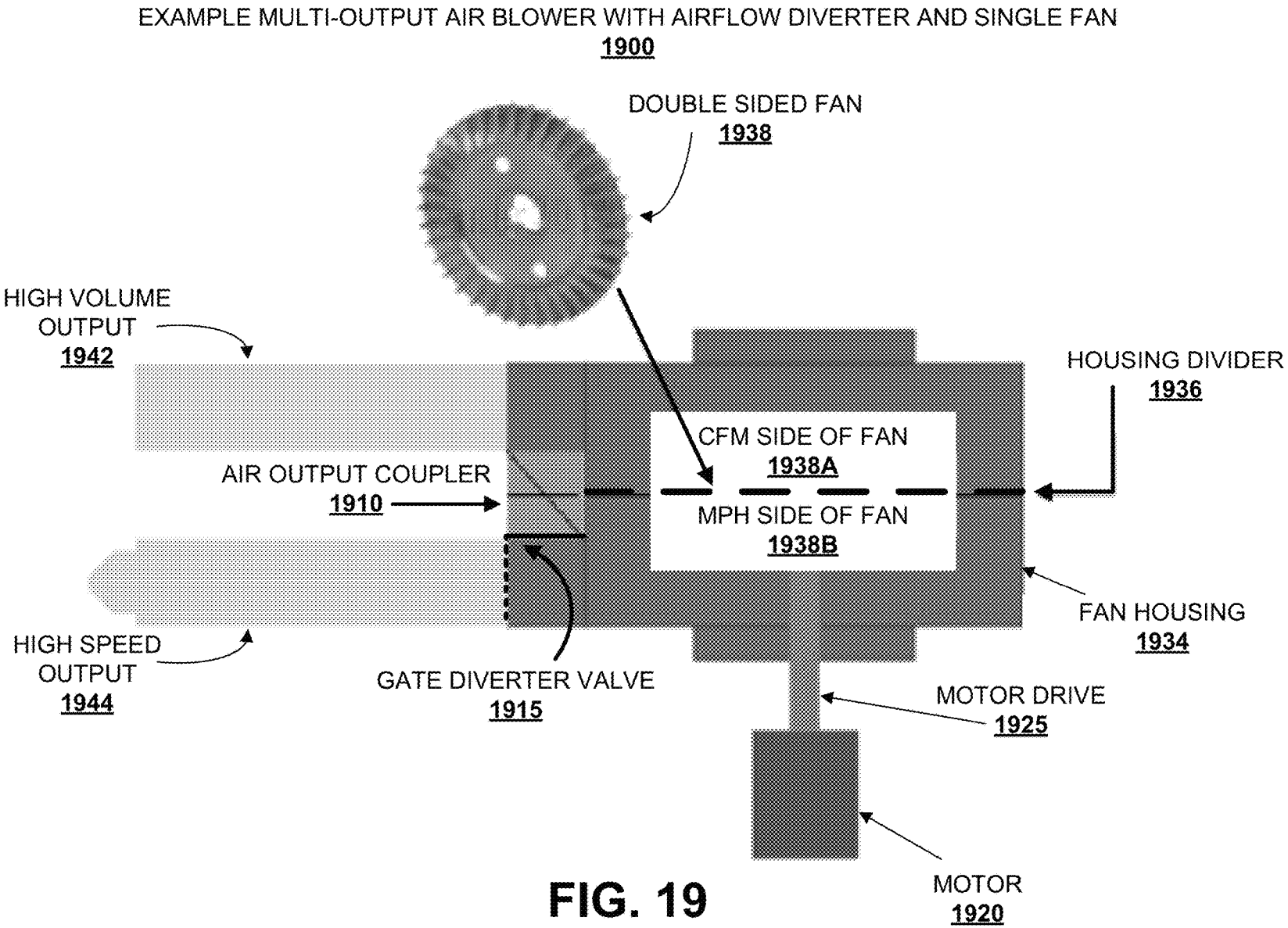
FIG. 19 illustrates an example multi-output air blower apparatus with diverter valve and single fan housing and fan with dual interior portions, in other aspects.

FIG. 19 provides a drawing of a multi-output air blower 1900 with airflow diverter and single fan, according to further embodiments of the present disclosure. Air blower 1900 comprises a fan housing 1934 mechanically connected to a motor 1920 by way of a motor drive 1925. Motor 1920 and motor drive 1925 drive rotation of a fan (see below) within fan housing 1934 to generate a plurality of airflows that are respectively output from a high volume output 1942 and a high speed output 1944. Moreover, the plurality of airflows can be generated by a single fan, as described below.

For instance, air blower 1900 can comprise a double-sided fan 1938 situated at an intersection of two interior portions of a fan housing 1934. Double-sided fan 1938 can form part of a housing divider 1936 that physically separates a first interior portion of fan housing 1934 from a second interior portion of fan housing 1934. A first side, or CFM side 1938A of double-sided fan 1938 can be in fluid communication with a first interior portion of fan housing 1934, and a second side, or MPH side 1938B of double-sided fan 1938 can be in fluid communication with a second interior portion of fan housing 1934. CFM side 1938A can have a different fan or blade geometry than MPH side 1938B. The difference can include a different number of blades, a different shape of blades, a different surface area of blades, or the like, or a suitable combination of the foregoing. Particularly, CFM side 1938A can have a blade geometry selected to drive a high volume airflow relative to MPH side, which can have a different blade geometry selected to drive a high speed airflow relative to CFM side.

In addition to the foregoing, an air output coupler 1910 can be provided that connects high speed output 1944 with high volume output 1942. A gate diverter valve 1915 is provided within air output coupler 1910. Gate diverter valve 1915 can selectively interconnect high speed output 1944 to high volume output 1942 by way of air output coupler 1910, and block throughput of high speed output 1944, by orienting gate diverter valve 1915 in a first orientation. By orienting gate diverter valve 1915 in a second orientation, air output coupler 1910 can instead be blocked and throughput of high speed output 1944 opened.

Figure 20:
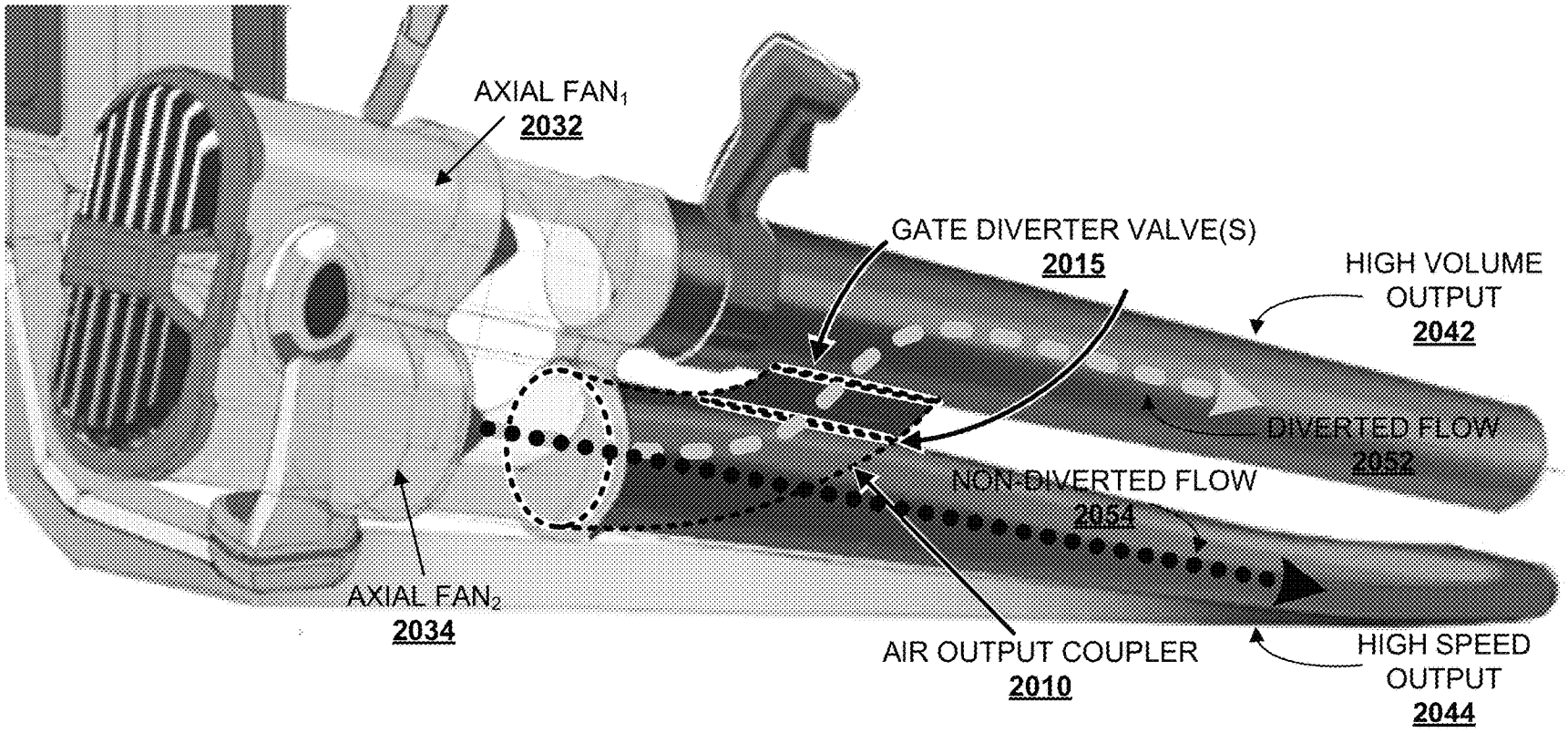
FIG. 20 depicts an example backpack-type multi-output air blower apparatus with dual axial fan housings and selectable diverter valve, in still other aspects of the disclosure.

FIG. 20 provides a drawing of a multi-output air blower 2000 with airflow diverter and dual axial fans in further disclosed embodiments. Air blower 2000 can comprise a first axial fan: axial fan$_1$ 2032 in a first fan housing adjacent (e.g., above) a second axial fan: axial fan$_2$ 2034 (referred to collectively as axial fans 2032-2034) in a second fan housing. An output of the first fan housing is in fluid communication with an intake of a high volume output shaft 2042, and a second output of the second fan housing is in fluid communication with a second intake of a high speed output shaft 2044. An air output coupler 2010 is provided that fluidly connects high speed output shaft 2044 with high volume output shaft 2042, including a gate diverter valve(s) 2015 that selectively opens and selectively closes the air output coupler 2010. When in an open orientation, airflow from the second fan housing is diverted to high volume output 2042 as a diverted flow 2052. When in a closed orientation, airflow from the second fan housing is a non-diverted flow 2054 that continues to an output port of high speed output 2044.

In regard to the various functions performed by the above described components, machines, devices, processes and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

For instance, the diagrams included herein are described with respect to several air blower apparatus, fan housings, fan geometries and airflow outputs. It should be appreciated that such diagrams can include apparatuses, housings, etc., specified therein, some of the specified apparatuses/housings/geometries/outputs, or additional apparatuses/housings/geometries/outputs not explicitly depicted but known in the art or reasonably conveyed to those of skill in the art by way of the context provided herein. Components of disclosed air blower apparatuses can also be implemented as sub-components of another disclosed component (e.g., axial fan housing 1132 and centrifugal fan housing 1134 can be integrated into a single enclosure with separate axial and centrifugal interior portions), whereas other components disclosed as sub-components can be separate components in various embodiments (e.g., axis of rotation 1060-1064 can be embodied in multiple support arms 1015 rather than integrated in a single support arm 1015). Further, embodiments within a particular Figure of the present specification can be applied in part or in whole to other embodiments depicted in other Figures without limitation, subject only to suitability to achieving a disclosed function or purpose as understood by one of skill in the art, and vice versa. As illustrative (and non-limiting) examples, rotatable output shaft 1426 of FIG. 14 can be substituted for high volume output 1042 and the upper axial fan housing 1022 and upper axial fan 1024 of blower assembly 1020 of FIG. 10, or similarly for blower assembly 1120 of FIG. 11, or similarly for air blower 1500 of FIG. 15, air blower 1600 of FIG. 16, and so forth. Components of the disclosed architectures can also interact with one or more other components not specifically described herein but known by those of skill in the art.

Aspects of the present disclosure provide an air blowing apparatus. The air blowing apparatus can comprise a body that defines a rigid structure, one or more straps secured to the body configured to secure the air blowing apparatus to an operator and a motor that generates mechanical power. Additionally, the air blowing apparatus can comprise a blower housing and a blower fan contained within the blower housing and powered by the motor to generate air pressure within the blower housing and an output shaft having an input fluidly coupled to the blower housing and a chute for directing an air flow in response to generation of the air pressure within the blower housing. Further, the air blowing apparatus can comprise a second output shaft adjacent to the output shaft having an input fluidly coupled to the blower housing or to a second blower housing that is adjacent the blower housing, wherein the second output shaft has a second chute for directing a second air flow from the blower housing or from the second blower housing. Still further, the air blowing apparatus can comprise a support arm secured at a first support coupling to the blower housing and secured at a second support coupling to the body of the air blowing apparatus to support a weight of the blower housing, output shaft and second output shaft a distance from the body of the air blowing apparatus, and having at least one axis of rotation to adjust an orientation or a position of the blower housing, output shaft and second output shaft.

In an aspect of these embodiments, the blower housing encloses the blower fan and defines an output fluidly coupled to the input of the output shaft; and the second blower housing encloses a second blower fan and defines a second output fluidly coupled to the input of the second output shaft, and the second blower fan generates air pressure within the second blower housing to produce the second air flow.

In another aspect, the blower fan and the second blower fan are both centrifugal fans and further the blower housing and the second blower housing are centrifugal fan housings.

In further aspects, the blower fan is a centrifugal fan and the blower housing is a centrifugal fan housing, and wherein the second blower fan is an axial fan and the second blower housing is an axial fan housing, and in another aspect, the air blowing apparatus can comprise a second motor that generates second mechanical power, wherein the second blower fan is powered by the second motor and second mechanical power to generate the air pressure within the second blower housing.

In another aspect, the air flow has a higher volume in cubic feet per minute (CFM) than the second air flow or has a lower speed in miles per hour (MPH) than the second air flow, or a combination of the foregoing. In still another aspect, the second chute of the second output shaft extends substantially parallel to the chute of the output shaft. In still additional aspects, the air blowing apparatus can further comprise a chute rotation coupling that rotatably secures the output shaft to the blower housing and is configured to rotate the output shaft relative to the second output shaft between a first position substantially parallel to the second output shaft and a second position between about ten degrees and about twenty degrees from parallel to the second output shaft.

In yet another aspect, the input of the second output shaft is coupled to the second blower housing, and further wherein the second blower housing is rotatably secured to the blower housing by a rotation coupling configured to selectively rotate the second blower housing and second output shaft relative to the output shaft. In further aspects of the disclosed embodiments, the second support coupling embodies the at least one axis of rotation and provides rotation of the blower housing, output shaft and second output shaft between a right side of the body of the air blowing apparatus facilitating a right-handed blowing operation, to a left side of the body of the air blowing apparatus facilitating a left-handed blowing operation. In further aspects, the first support coupling embodies the at least one axis of rotation and provides rotation of the blower housing, output shaft and second output shaft vertically about the first support coupling to the blower housing. In still further aspects, the second support coupling embodies the at least one axis of rotation and provides rotation of the blower housing, output shaft and second output shaft between a right side of the body and a left side of the body and the air blowing apparatus can comprise a second axis of rotation embodied by the first support coupling facilitating vertical rotation of the output shaft and second output shaft about the first support coupling and a third axis of rotation along the support arm between the first support coupling and the second support coupling facilitating horizontal rotation of the blower housing, the output shaft and the second output shaft.

In one or more additional aspects of the present disclosure, there is provided an air blowing apparatus configured to removably secure to a torso of an operator. The air blowing apparatus can comprise a body providing a rigid support structure, a strap assembly coupled to the body of the air blowing apparatus and configured to removably secure the body to a torso of an operator, a fan housing connected to the body and enclosing a fan coupled to a drive mechanism and defining a first fan housing output and a motor having a motor output connected to the drive mechanism, wherein the motor generates mechanical power at the motor output to drive rotation of the fan. In further aspects, the air blowing apparatus can comprise an airflow output defining an intake port coupled to the fan housing output and directing airflow generated in response to rotation of the fan within the fan housing along a length of the airflow output to a first output port, and in yet another aspect, the air blowing apparatus can comprise a second airflow output defining a second intake port coupled to a second fan housing output and directing second airflow from the second fan housing output along a length of the second airflow output to a second output port, wherein the second airflow defines at least one of: a different volumetric flow rate or a different airflow speed than the airflow.

In an additional aspect of the herein embodiments, the fan housing comprises a first housing interior that defines the fan housing output and a second housing interior, physically separated from the first housing interior, that defines the second fan housing output. The air blowing apparatus can further comprise a first air intake coupled to the fan housing and providing external air to the first housing interior and can comprise a second selectable air intake coupled to the second housing interior, wherein the second selectable air intake is coupled to a selectable intake baffle movable between an open position and a closed position, wherein in the open position the selectable intake baffle permits air external to the second housing interior to enter the second housing interior, and in the closed position mitigates or prevents air external to the second housing interior from entering the second housing interior.

In an aspect of the disclosure, the air blowing apparatus can further comprise a second fan housing connected to the body adjacent to the fan housing. The second fan housing can enclose a second fan coupled to the drive mechanism or to a second drive mechanism and the second fan housing can define the second fan housing output coupled to the second intake port of the second output shaft; and further wherein the second airflow is generated in response to rotation of the second fan within the second fan housing.

In another aspect, the fan housing defines an intake to receive external air into the fan housing in fluid communication with the fan, and wherein the second fan housing comprises a second intake and a baffle configured to selectively open to permit external air into the second fan housing and to close to restrict external air from the second fan housing. In still another aspect, the fan and the second fan are both centrifugal fans and the fan housing and the second fan housing are both centrifugal fan housings. And in yet another aspect, the fan housing and second fan housing are oriented substantially vertically with respect to one another on the body and define a substantially vertical axis of rotation for the fan and the second fan, and other aspects the fan housing and second fan housing are oriented substantially horizontally with respect to one another on the body and define a substantially horizontal axis of rotation for the fan and the second fan. In at least one further aspect, one of: the fan or the second fan, is a centrifugal fan and a second of: the fan or the second fan, is an axial fan.

In alternative or additional embodiments of the present disclosure, there is provided an air blowing apparatus. The air blowing apparatus can comprise a motor having a motor output generating mechanical power, a fan housing enclosing a fan coupled to the motor output and defining a first fan housing output, a second fan housing defining a second fan housing output and an airflow output shaft defining an intake port fluidly coupled to the first fan housing output and directing airflow generated in response to rotation of the fan within the fan housing along a length of the airflow output to a first output port. The air blowing apparatus can further comprise a second airflow output shaft defining a second intake port fluidly coupled to the second fan housing output and receiving second airflow, generated within the second fan housing, from the second fan housing output, a second airflow output shaft defining a second intake port fluidly coupled to the second fan housing output and receiving second airflow, generated within the second fan housing, from the second fan housing output and a selectable diverter valve located at least at an intersection of the air output coupler and the second airflow output shaft having a first orientation and a second orientation, wherein in the first orientation the selectable diverter valve directs the second airflow from the second fan housing output to a second output port defined by the second airflow output shaft, and wherein in the second orientation the selectable diverter valve directs the second airflow from the second fan housing output through the air output coupler into the airflow output shaft and out the first output port together with the airflow.

In an aspect of the air blowing apparatus, the fan is a dual-sided fan rotatably positioned at an intersection of the fan housing and the second fan housing, one side of the dual-sided fan is in fluid communication with an interior of the fan housing, a second side of the dual-sided fan is in fluid communication with an interior of the second fan housing. In a further aspect, the one side generates the airflow within the fan housing in response to rotation of the fan by the motor output the one side generates the airflow within the fan housing in response to rotation of the fan by the motor and the second side generates the second airflow within the second fan housing in response to the rotation of the fan.

In still further aspects, the air blowing apparatus can comprise a second fan enclosed by the second fan housing and coupled to the motor output or coupled to a second motor output of a second motor of the air blowing apparatus, wherein the second fan is configured to rotate within the second fan housing and generate the second airflow in response to the mechanical power at the motor output or in response to second mechanical power of the second motor at the second motor output.

In an aspect, the air blowing apparatus can further comprise: a body providing a rigid structure, a strap assembly coupled to the body and configured to removably secure to a torso of an operator and a support arm secured at one end to the fan housing and second fan housing and secured at a second end to the body, the support arm extends outward from a right side of the body to facilitate a right-handed operation of the air blowing apparatus or extends outward from a left side of the body to facilitate a left-handed operation of the air blowing apparatus, and is optionally rotatable between the left side and the right side by way of one or more axis of rotation integrated in the support arm. In another aspect, the air blowing apparatus can comprise a handle at a top side of the air blowing apparatus and a ground support at a bottom side of the air blowing apparatus.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In other embodiments, combinations or sub-combinations of the above disclosed embodiments can be advantageously made. Moreover, embodiments described in a particular drawing or group of drawings should not be limited to those illustrations. Rather, any suitable combination or subset of elements from one drawing(s) can be applied to other embodiments in other drawings where suitable to one of ordinary skill in the art to accomplish objectives disclosed herein, known in the art, or reasonably conveyed to one of ordinary skill in the art by way of the context provided in this specification. Where utilized, block diagrams of the disclosed embodiments or flow charts are grouped for ease of understanding. However, it should be understood that combinations of blocks, additions of new blocks, re-arrangement of blocks, and the like are contemplated in alternative embodiments of the present disclosure.

Based on the foregoing it should be understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An air blowing apparatus, comprising:

a fan coupled to a drive mechanism that defines an axis of rotation for the fan;

a fan housing enclosing the fan and that defines a space within which the fan rotates in response to a rotational force applied to the drive mechanism;

a motor coupled to the drive mechanism that generates and applies the rotational force to the drive mechanism causing the fan to rotate within the fan housing;

an intake defined at a surface of the fan housing for receiving air external to the air blowing apparatus into the fan housing, the air interacting with the fan, wherein rotation of the fan within the fan housing while in communication with the air generates first pressurized air;

a first output fluidly coupled with the fan housing that receives the first pressurized air and directs the first pressurized air to a first blower exhaust port;

a second fan housing;

a second intake defined adjacent to the second fan housing having a variable baffle opening that is adjustable between an open position and a closed position, wherein second external air is received from outside the air blowing apparatus into the second fan housing in response to the variable baffle opening being in the open position and the second external air is impeded from entering the second fan housing in response to the variable baffle opening being in the closed position; and a second output fluidly coupled with the second fan housing that receives second pressurized air generated within the second fan housing in response to the rotational force applied to the drive mechanism and in response to the variable baffle opening being in the open position, wherein the second output directs the second pressurized air to a second blower exhaust port.

2. The air blowing apparatus of claim 1, wherein the air blowing apparatus is a hand-held air blowing apparatus and wherein the motor is an electric motor powered by a rechargeable battery secured to the hand-held air blowing apparatus.

3. The air blowing apparatus of claim 1, wherein the first blower exhaust port has a fixed position oriented above the second blower exhaust port in a position held by an operator, causing the first pressurized air to be directed outward from the air blowing apparatus above the second pressurized air.

4. The air blowing apparatus of claim 1, wherein the first output or the second output are formed of a rigid material that defines a fixed first blower exhaust port or a fixed second blower exhaust port, respectively.

5. The air blowing apparatus of claim 1, wherein the first output and the first blower exhaust port define a wide output path and wide output opening relative to the second blower exhaust port that facilitates a high volume air output from the air blowing apparatus utilizing the first pressurized air.

6. The air blowing apparatus of claim 5, wherein the second output and the second blower exhaust port define a narrow output opening relative to the first blower exhaust port that facilitates a high speed air output from the air blowing apparatus utilizing the second pressurized air.

7. The air blowing apparatus of claim 6, wherein in response to the variable baffle opening being in the open position the air blowing apparatus generates the high volume air output from the wide output opening of the first blower exhaust port and generates the high speed air output from the narrow output opening of the second blower exhaust port.

8. The air blowing apparatus of claim 1, wherein the first output is fluidly coupled with the fan housing at a top portion of the fan housing and wherein the first blower exhaust port is directed downward from the top portion of the fan housing as the first blower exhaust portion extends away from the fan housing.

9. The air blowing apparatus of claim 1, wherein the second output is fluidly coupled with the second fan housing at a top portion of the second fan housing and wherein the second blower exhaust port is directed downward from the top portion of the second fan housing as the second blower exhaust portion extends away from the second fan housing.

10. The air blowing apparatus of claim 1, wherein the first output is fluidly coupled with the fan housing at a bottom portion of the fan housing and wherein the second output is fluidly coupled with the second fan housing at a bottom portion of the second fan housing.

11. The air blowing apparatus of claim 1, further comprising a second fan coupled to the drive mechanism and enclosed within the second fan housing, wherein the second fan rotates in response to the rotational force applied by the motor to the drive mechanism and wherein in response to the variable baffle opening being in the open position the second external air is received within the second fan housing and is in communication with the second fan during rotation of the second fan to generate the second pressurized air within the second fan housing.

12. The air blowing apparatus of claim 11, wherein the second intake is positioned between the fan housing and the second fan housing and wherein the drive mechanism extends from the motor to the second fan within the second fan housing, through the second intake and to the fan within the fan housing.

13. The air blowing apparatus of claim 1, wherein:

the second fan housing is adjacent to the fan housing;

the fan is positioned at an intersection of the fan housing and the second fan housing;

a first surface of the fan defines a first fan pattern that rotates within the fan housing in response to the rotational force applied to the drive mechanism and is in communication with the air and generates the first pressurized air; and a second surface of the fan defines a second fan pattern that rotates within the second fan housing in response to the rotational force applied to the drive mechanism and, in response to the variable baffle opening being in the open position, the second fan pattern is in communication with the second external air and generates the second pressurized air.

14. The air blowing apparatus of claim 13, wherein the second intake is on a surface of the second fan housing adjacent the motor, a divider surface is shared by the fan housing and the second fan housing and the intake is on a far surface of the fan housing relative the divider surface.

15. The air blowing apparatus of claim 1, further comprising an intake actuator that facilitates operator control over the variable baffle opening and physical transition between the open position and the closed position and there between.

16. A hand-carried air blowing apparatus having multiple air output ports, comprising:

a first output port having a first output surface area;

a second output port having a second output surface area, wherein the second output surface area is smaller than the first output surface area;

a first housing coupled to the first output port and physically isolated from the second output port;

a second housing coupled to the second output port and physically isolated from the first output port, wherein an adjustable air intake baffle defines at least a portion of the surface of the second housing and is configured to be adjusted between an open position and a closed position;

an operator handle that facilitates single-handed carrying of the hand-carried air blowing apparatus;

a motor providing mechanical power to the first housing or the second housing, or both, of the hand-carried air blowing apparatus; and air pressurization means responsive to the mechanical power output by the motor and configured to generate first airflow within the first housing and expelled from the first housing via the first output port and configured to conditionally generate second airflow within the second housing and expelled via the second output port in response to the adjustable air intake baffle satisfying the condition of being adjusted to the open position.

17. The hand-carried air blowing apparatus of claim 16, wherein the air pressurization means comprises a first fan positioned within the first housing to generate the first airflow and a second fan positioned within the second housing to conditionally generate the second airflow.

18. The hand-carried blowing apparatus of claim 16, wherein the air pressurization means comprises a fan having a first fan surface and a second fan surface, wherein the first fan surface is exposed to the first housing in communication with air provided by a first housing intake to generate the first airflow, and wherein the second fan surface is exposed to the second housing to facilitate conditional generation of the second airflow.

19. The hand-carried blowing apparatus of claim 16, further comprising a rechargeable battery for providing electrical power to the motor, wherein the motor is an electrical motor.

* * * * *